US009060391B2

(12) United States Patent
Fushimi

(10) Patent No.: US 9,060,391 B2
(45) Date of Patent: Jun. 16, 2015

(54) LIGHTING SYSTEM

(71) Applicant: PANASONIC CORPORATION, Osaka (JP)

(72) Inventor: Shigemi Fushimi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 155 days.

(21) Appl. No.: 14/023,511

(22) Filed: Sep. 11, 2013

(65) Prior Publication Data

US 2014/0070706 A1 Mar. 13, 2014

(30) Foreign Application Priority Data

Sep. 13, 2012 (JP) ..... 2012-201081

(51) Int. Cl.
*H05B 37/02* (2006.01)
*H05B 33/08* (2006.01)

(52) U.S. Cl.
CPC ..... *H05B 37/02* (2013.01); *H05B 33/0863* (2013.01); *H05B 37/0272* (2013.01)

(58) Field of Classification Search
USPC ..... 315/131, 149, 291, 308; 700/275, 295, 700/296, 297
See application file for complete search history.

(56) References Cited

U.S. PATENT DOCUMENTS

2011/0230984 A1* 9/2011 Osawa et al. ..... 700/90
2011/0285515 A1* 11/2011 Fushimi et al. ..... 340/12.22

FOREIGN PATENT DOCUMENTS

JP 2000-311791 11/2000
JP 2006-277972 10/2006

* cited by examiner

*Primary Examiner* — Douglas W Owens
*Assistant Examiner* — Thai Pham
(74) *Attorney, Agent, or Firm* — Greenblum & Bernstein, P.L.C.

(57) ABSTRACT

A lighting system has lighting apparatuses and a controller for the lighting apparatuses. The controller includes a display unit and a storage unit that stores attribute information. The storage unit stores, as attribute information, area information including a target area where the lighting apparatuses are installed, identification information of the lighting apparatuses in the target area, and lighting information on lighting conditions of the lighting apparatuses. The display unit displays a first operation screen that includes a first graphic generated from the area information and the identification information, and a second operation screen that includes a second graphic generated from the lighting information. The second operation screen is displayed as a dialog, so as to be superposed on the first operation screen, and the first graphic indicating the selected lighting apparatus and the peripheral area thereof is highlighted on the first operation screen.

17 Claims, 14 Drawing Sheets

LIGHTING SYSTEM

BACKGROUND OF THE INVENTION

1. Field of the Invention

The present invention relates generally to lighting systems and, more particularly, to a lighting system that controls a plurality of lighting apparatuses according to the control content that is set by a controller.

2. Description of the Related Art

A lighting setting device, which arbitrarily sets the luminosity of a plurality of lighting apparatuses installed indoors and the illuminance at each position indoors according to the intended use to produce a scene based on lighting, has been known. In order to produce a scene like this, a dimming console is used, which includes a plurality of faders for setting an output level of a predetermined dimming control signal for each channel corresponding to each of dimmers connected to a plurality of lighting apparatuses, respectively (e.g. Japanese Patent Application Publication No. 2000-311791).

However in the case of the dimming console disclosed in Japanese Patent Application Publication No. 2000-311791, correspondence of each lighting apparatus and fader is hard to know, and operation is complicated. As a technique to solve this problem, a lighting setting device is available which uses a display device to detect the operation indication by the user, such as a liquid crystal touch panel, as a display unit for displaying a flashing state and luminosity setting state of each lighting apparatus, whereby allowing the control of the flashing and luminosity of each lighting apparatus (e.g. Japanese Patent Application Publication No. 2006-277972).

The lighting setting device according to Japanese Patent Application Publication No. 2006-277972, however, is used for setting the luminosity of a plurality of lighting fixtures installed on an indoor ceiling, and is never meant to be used for living room illumination in general residences for example. Lighting apparatuses in a general residence are installed not only on the ceiling but also in various locations, including a wall and floor, and the shapes and colors of the illumination light of the lighting apparatuses also varies. The lighting setting device disclosed in Japanese Patent Application Publication No. 2006-277972 simply indicates a plurality of lighting fixtures installed on the indoor ceiling as a planar image, hence it is difficult for a general user to imagine a control state of each lighting apparatus in a target area where the lighting apparatuses are installed, and producing a desired scene is not so easy.

SUMMARY OF THE INVENTION

With the foregoing in view, it is an object of the present invention to provide a lighting system which allows a general user to select a control target lighting apparatus intuitively in a target area where lighting apparatuses are installed, and to set lighting attribute information, such as the lighting state, with good operability.

A lighting system of the present invention is a lighting system having lighting apparatuses, and a controller for setting lighting control content of the lighting apparatuses, wherein the controller includes a display unit that displays attribute information of the lighting apparatuses, an operation unit that is integrated with the display unit and detects an operation indication, a storage unit that stores the attribute information, and a transmitting/receiving unit that transmits/receives a control signal including attribute information of the lighting apparatuses to/from the lighting apparatuses, the storage unit stores, as the attribute information, area information including a target area where the lighting apparatuses are installed, identification information of the lighting apparatuses in the target area, and lighting information on lighting conditions of the lighting apparatuses, the display unit two-dimensionally or three-dimensionally displays a first operation screen that includes a first graphic generated from the area information and the identification information, and a second operation screen that includes a second graphic generated from the lighting information, respectively, and if a control target lighting apparatus is selected from among the lighting apparatuses on the first operation screen by an operation indication on the operation unit, the display unit displays, as a dialog, the second operation screen having the second graphic corresponding to the selected lighting apparatus so as to be superposed on the first operation screen, and if lighting information on the selected lighting apparatus is selected on the second operation screen, the display unit highlights a first graphic that indicates identification information of the selected lighting apparatus and area information corresponding to the peripheral area of the selected lighting apparatus on the first operation screen, so that the selected lighting information is reflected.

In the lighting system, it is preferable that the identification information of the lighting apparatuses includes position information of the lighting apparatuses in the target area, and when a lighting apparatus is selected from among the lighting apparatuses on the first operation screen by the operation indication, and coordinate information of the selected lighting apparatus is moved, the storage unit updates the position information of the selected lighting apparatus based on the moved coordinate information, and the display unit displays a first graphic that indicates the updated position information of the selected lighting apparatus.

In the lighting system, it is preferable that the storage unit stores identification information of other lighting apparatuses which are not installed in the target area, and the display unit displays a first graphic that indicates the identification information of the other lighting apparatuses stored in the storage unit, in an area outside a first graphic that indicates the area information, and when a lighting apparatus is selected from among the other lighting apparatuses on the first operation screen by the operation indication and coordinate information of the lighting apparatus selected from among the other lighting apparatuses moves inside the area information, the display unit displays the identification information of the lighting apparatus selected from among the other lighting apparatuses in an area inside the first graphic that indicates the area information.

In the lighting system, it is preferable that the storage unit stores a plurality of pieces of lighting information relevant to each of the lighting apparatuses, and the display unit displays, on the second operation screen, a second graphic which displays the plurality of pieces of lighting information in one batch.

In the lighting system, it is preferable that the storage unit stores a plurality of pieces of lighting information relevant to each of the lighting apparatuses, and the display unit displays, on the second operation screen, a second graphic which associates together and displays the plurality of pieces of lighting information.

In the lighting system, it is preferable that the storage unit stores a plurality of pieces of lighting information relevant to each of the lighting apparatuses, the plurality of pieces of lighting information include the dimming ratio information and the color temperature information, the display unit displays, on the second operation screen, a second graphic which indicates a predetermined dimming/toning curve defining the dimming ratio and the color temperature of the selected lighting apparatus in association with each other, and when one of the dimming ratio information and the color temperature information of the selected lighting apparatus is selected on the second operation screen by an operation indication, the controller automatically selects the other of the color temperature information and the dimming ratio information according to the dimming/toning curve.

In the lighting system, it is preferable that the second graphic is circular, and when the operation indication is rotationally moved around the center point of the circle of the second graphic on the second operation screen, the controller selects the lighting information according to the rotation angle thereof.

In the lighting system, it is preferable that the second graphic is rectangular, and when the operation indication is linearly moved along a longitudinal direction of the second graphic on the second operation screen, the controller selects the lighting information according to the moving distance thereof.

In the lighting system, it is preferable that when two points of indication coordinates are inputted on the second operation screen as the operation indication, and a distance between the indication coordinates is changed, the controller selects the lighting information according to the distance between the indication coordinates.

In the lighting system, it is preferable that when two points of indication coordinates are inputted on the second operation screen as the operation indication, and a segment connecting the indication coordinates is rotationally moved, the controller selects the lighting information according to the rotation angle thereof.

In the lighting system, it is preferable that when the operation indication is linearly moved on the first operation screen, the display unit displays, on the first operation screen, a first graphic which indicates area information of which positional relationship corresponds to a moving direction of the operation indication.

In the lightening system, it is preferable that when two points of indication coordinates are inputted on the first operation screen as the operation indication, and a distance between the indication coordinates is changed, the display unit zooms in or zooms out of a first graphic included in the first operation screen with the center of the two indication coordinates as a reference according to a distance between the indication coordinates.

In the lighting system, it is preferable that when two points of indication coordinates are inputted on the first operation screen as the operation indication, and a segment connecting the indication coordinates is rotationally moved, the display unit rotationally displays a first graphic included in the first operation screen with the center of the two indication coordinates as a reference according to the rotation angle thereof.

It is preferable that the lighting system further has a regulator that controls the lighting of the lighting apparatus based on a control signal outputted from the controller.

According to the present invention, a space (an area information) where lighting apparatuses are disposed is two-dimensionally or three-dimensionally displayed on a first operation screen on the display unit of the controller, and a second operation screen for setting the lighting information of each lighting apparatus is displayed as a dialog on the first operation screen. If the lighting information is set, the identification information of the set lighting apparatus and the area information on the peripheral area thereof are highlighted on the first operation screen. This allows the user to imagine the target area where the control target lighting apparatus is installed and the lighting information of the control target lighting apparatus, hence a general user can intuitively select the control target lighting apparatus and set the light attribute information, such as the lighting state thereof, with good operability.

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF EXEMPLARY EMBODIMENTS

Figure 1:
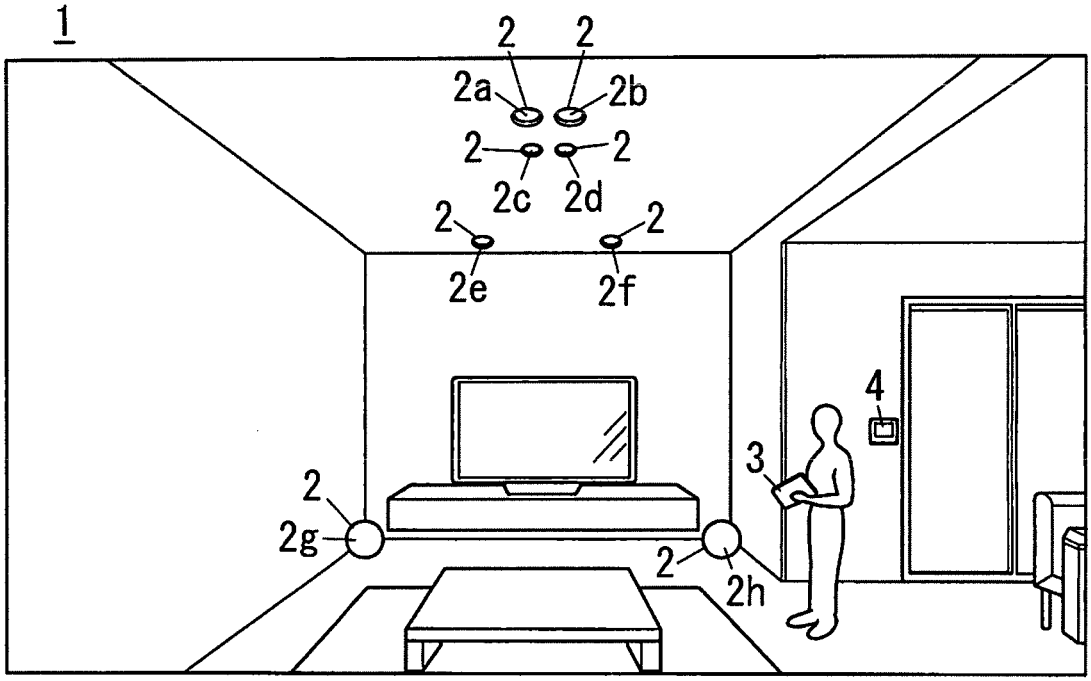
FIG. 1 is a one-point perspective view depicting a configuration of a lighting system according to an embodiment of the present invention.

A lighting system according to an embodiment of the present invention will now be described with reference to the drawings. As illustrated in FIG. 1, the lighting system 1 has a plurality of lighting apparatuses 2*a* to 2*h* (simply called "lighting apparatus 2" hereinbelow if a distinction of lighting apparatuses is not required), and a controller 3 for setting the lighting control content of each lighting apparatus 2. The lighting system 1 is ideally used as an indoor lighting system of a general residence or a lighting system inside a building. Further, the lighting system of this embodiment includes a regulator 4 that controls the lighting of the plurality of lighting apparatuses 2 based on a control signal transmitted from the controller 3, as illustrated.

Each of the plurality of lighting apparatuses 2 has individual identification information. If the identification information of a lighting apparatus 2 to be controlled by the controller 3 and the lighting control content (lighting information) of the lighting apparatus 2 are set, the control target lighting apparatus 2 receives the lighting information that is set, directly or via the regulator 4. The identification information refers to information that allows identifying an individual light apparatus 2, and is not only an individual identification number (ID) assigned to each lighting apparatus 2, but also includes an icon visualizing each lighting apparatus 2. The lighting information is basically a dimming ratio (light quantity) and color temperature of the illumination light, and could include chromaticity, saturation and brightness. The identification information and lighting information of the lighting apparatus 2 is collectively referred to as the "attribution information" of the lighting apparatus 2.

The lighting apparatuses 2*a* to 2*f* illustrated in FIG. 1 are fixed type lighting apparatuses (downlights) installed on a ceiling. The lighting apparatuses 2*g* and 2*h* are movable lighting apparatuses, and are placed on a floor surface. Each lighting apparatus 2 can be either a fixed type that is secured in a predetermined installation location, or a movable type of which installation location can be changed. The fixed type lighting apparatuses are not only downlights as illustrated in FIG. 1, but may also be a ceiling light, base light, spot light, pendent light, a cornice lighting apparatus or a cove lighting apparatus, for example. The movable type lighting apparatuses may be a wiring duct type spot light, which can be moved along a rail secured on a ceiling or the like, or an elevating type pendant light that can be moved vertically along a rail secured on a wall or the like, for example. The movable type lighting apparatuses also include a stand light, lantern/torch, display and digital signage. A lighting apparatus that can either be a fixed type or a movable type is an integrated type of lighting apparatus of which light source is built into furniture or a building component. In the case of such an integrated type lighting apparatus, a light emitting aperture is formed in an object in which the light source is built in, and the light emitting aperture is covered with a transparent light guide plate. A number of lighting apparatuses 2, and type and arrangement of each lighting apparatus 2 are not limited to the illustration in FIG. 1.

In each lighting apparatus 2, optical elements, and a reflector or the like are installed according to the format and intended use. The optical elements are, for example, various lenses, a prism, a louver and a filter. The filter to be used is selected out of filters having such a function as light diffusion, light collection, polarization, wavelength truncation and wavelength conversion, according to the intended use. The optical elements are constituted by a translucent plastic, glass, coated metal sheet or the like. The reflector is for reflecting light to a desired direction, and is constituted by an anodized aluminum reflector, aluminum deposition reflector, silver deposition reflector, resin reflector, cold mirror or the like, and the reflecting surface thereof is formed to be a mirror face, a light diffusion surface or the like. If necessary, each lighting apparatus 2 may include a liquid or liquid crystal lens for changing transmittance or directivity according to the input voltage.

Figure 2:
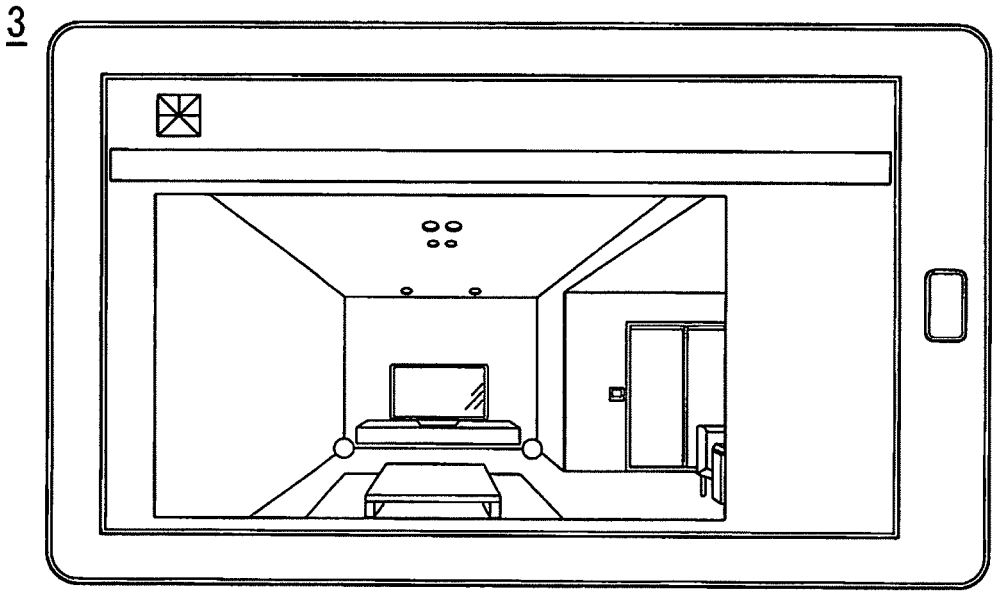
FIG. 2 is a front view of a controller that is used for the lighting system according to the embodiment of the present invention.

The controller 3 is a portable terminal which can be carried to any indoor location, and allows the transmission/reception of predetermined control signals between the lighting apparatus 2 and the control unit 4 by radio communication. The controller 3 displays an image and has a touch panel where the user can input the operation indication information by touching the image on the touch panel with a finger. As illustrated in FIG. 2, a multi-function portable terminal, such as a tablet or smart phone on which dedicated software has been installed, can be suitable used for the controller 3. The later mentioned attribute information of the lighting apparatus 2 is displayed on the touch panel of the controller 3. A dedicated terminal of the lighting system 1 may be used for the controller 3, or a remote controller for a game machine, digital camera, PDA, music player, portable lighting apparatus represented by a lantern/torch, a portable watch or the like may be used for this purpose.

The regulator 4 can communicate with fixed type lighting apparatuses 2*a* to 2*f* by cable or radio, and with movable lighting apparatuses 2*g* and 2*h* by radio, and can communicate with the controller 3 by radio. The regulator 4 itself is mounted on an indoor wall, as illustrated in FIG. 1, but a later mentioned operation unit (display unit) of the regulator 4 may be removable from a wall mount.

Figure 3:
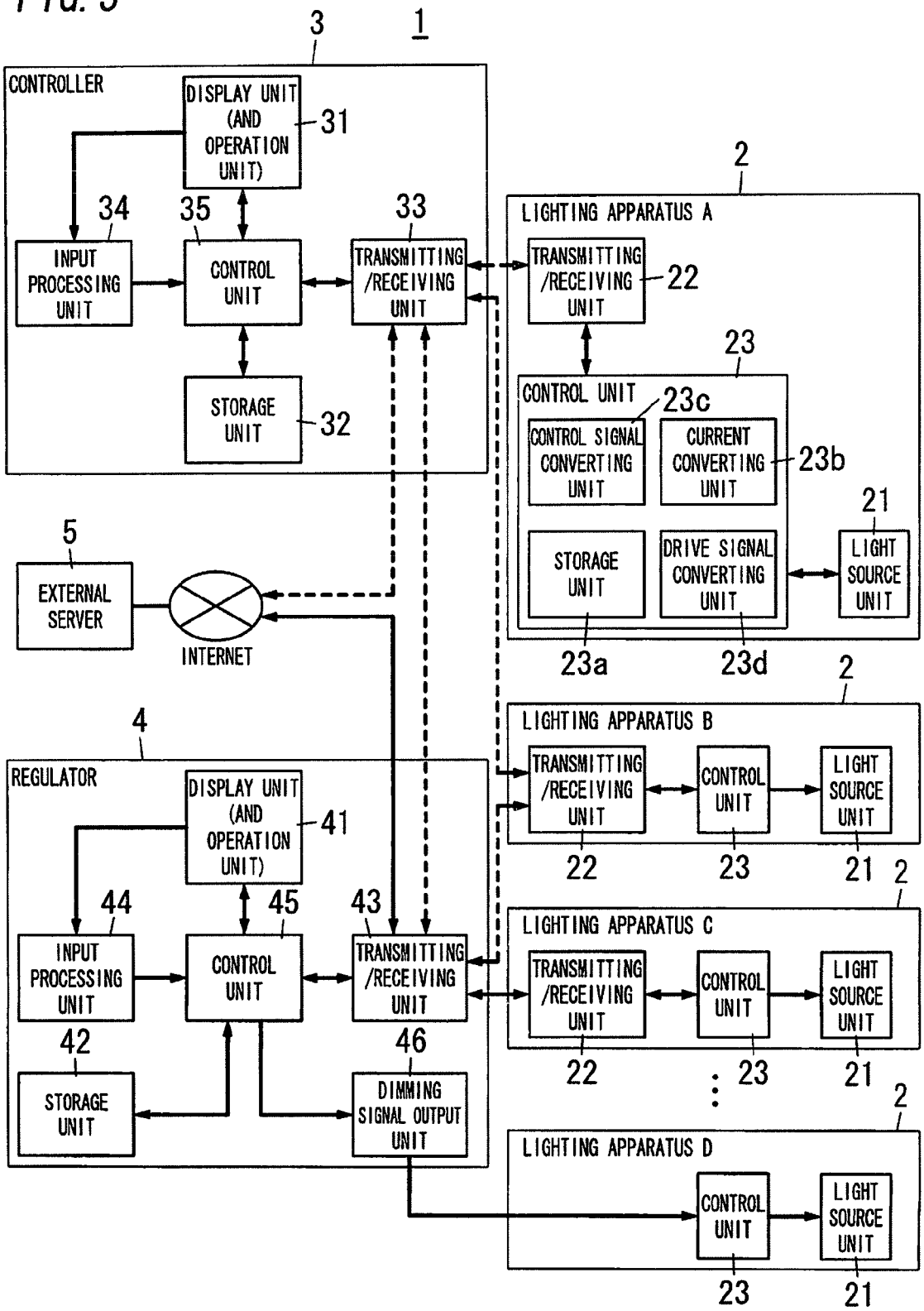
FIG. 3 is a block diagram depicting the lighting system according to the embodiment of the present invention.

FIG. 3 is an example of a block configuration of the lighting system 1. In FIG. 3, a broken lined arrow connecting configuration blocks indicates radio communication, and a solid lined arrow indicates cable communication. The lighting apparatuses 2 (A to D) in FIG. 3 do not correspond to the lighting apparatuses 2*a* to 2*h* in FIG. 1. In FIG. 3, the lighting apparatus A is connected with the controller 3 by radio, the lighting apparatus B is connected with the controller 3 and the regulator 4 by radio, and the lighting apparatuses C and D are connected with the regulator 4 by cable. The lighting apparatus D is a conventional type lighting apparatus which has no specific transmitting/receiving unit. The controller 3 and the regulator 4 can be connected not only with the lighting apparatuses 2 included in the system, but also connected via Internet with an external server 5 holding data on the identification information of lighting apparatuses 2 outside the system, and can download various data from the external server 5. Here for convenience, the configuration of the control unit of the lighting apparatus 2 will be described in detail only for the lighting apparatus A.

The controller 3 includes a display unit 31 that displays the attribute information of the lighting apparatus 2, a storage unit 32 that stores the attribute information, and a transmitting/receiving unit 33 that transmits/receives control signals including the attribute information to/from the lighting apparatus 2. The display unit 31 is the above mentioned touch panel, which integrates an operation unit that detects an operation indication. For the operation unit, a touch panel or a button type switch, separate from the display unit 31, for example, may be used. The controller 3 also includes an input processing unit 34 that acquires coordinate information to indicate the position of the operation indication detected by the operation unit, and a control unit 35 that drives the display unit 31 or the like, and controls the transmission/reception of control signals in the transmitting/receiving unit 33. The controller 3 further includes a control power supply unit that receives the required power from an external power supply, and a battery having a predetermined capacity (both not illustrated).

For the display unit 31, a display device that can detect the indication of the user, just like the liquid crystal touch panel, and can also display the data, can be suitably used. The touch panel (operation unit) of this display unit 31 is a resistive film type or a capacitive sensing type, which detects the position coordinates pressed by a finger tip of the user, a pen or the like, that contacts the surface of the display unit 31 and outputs position coordinate information that indicates the position coordinates to the input processing unit 34.

The storage unit 32 stores area information including the target area, where lighting apparatuses 2 are installed, and identification information and lighting information of the lighting apparatuses 2 in the target area, as attribute information on the lighting apparatuses 2. For the storage unit 32, a general purpose memory, such as EEPROM, is used.

The input processing unit 34 acquires indication coordinate information, which is information to show a position of the operation indication by the user, from the position coordinate information detected by the operation unit, and outputs the indication coordinate information to the control unit 35. This output is performed by software for transferring the indication coordinate information received from a display driver of the display unit 31 to the control unit 35. The indication coordinate information is xy coordinate information, and this software transfers a plurality of pieces of indication coordinate information to the control unit 35 simultaneously. Further, this software transfers the pressed ON/OFF information and the elapsed time (touch time) from ON to OFF to the control unit 35 simultaneously, based on the operation indication detected by the operation unit. In concrete terms, this software identifies a double-click and a long-press (e.g. 2 seconds or longer) in the information transfer, and executes input processing. The indication coordinate information may include information to indicate pressing ON/OFF. For example, if a case, when the operation indication is outside a predetermined area of the xy coordinates, is regarded as pressing OFF, and a case, when the operation indication is within the predetermined area of the xy coordinates, is regarded as pressing ON, then information to indicate pressing ON/OFF can be included in the coordinate indication.

The control unit 35 performs control to generate display data for the display unit 31 of the controller 3, and to generate and transmit/receive various control signals for the lighting apparatuses 2 or the regulator 4, according to the control signals sent from the input processing unit 34 based on the operation indication. The control unit 35 is constituted by an MPU, memory and the like, and can be implemented by storing processing programs in the memory. The control unit 35 may be implemented by dedicated hardware.

The transmitting/receiving unit 33 of the controller 3 transmits/receives data to/from the regulator 4 and the lighting apparatuses 2 via radio communication or cable communication. The data to be transmitted/received is structured as a "communication command", "lighting apparatus identification information", and "lighting information (e.g. dimming ratio, color temperature) of the lighting apparatus". For the radio communication, UDP communication protocol can be suitably used in the case of a radio LAN (WiFi), for example, or visible light communication, and a standard of infrared data communication (IrDA), radio frequency (RF), a standard of near field communication (IEEE 802.15.1), and a specified low power radio or the like may be used. For the cable communication, DALI, a standard of cable LAN (e.g. IEEE 802.3), and power line communication or the like can be used.

Figure 4:
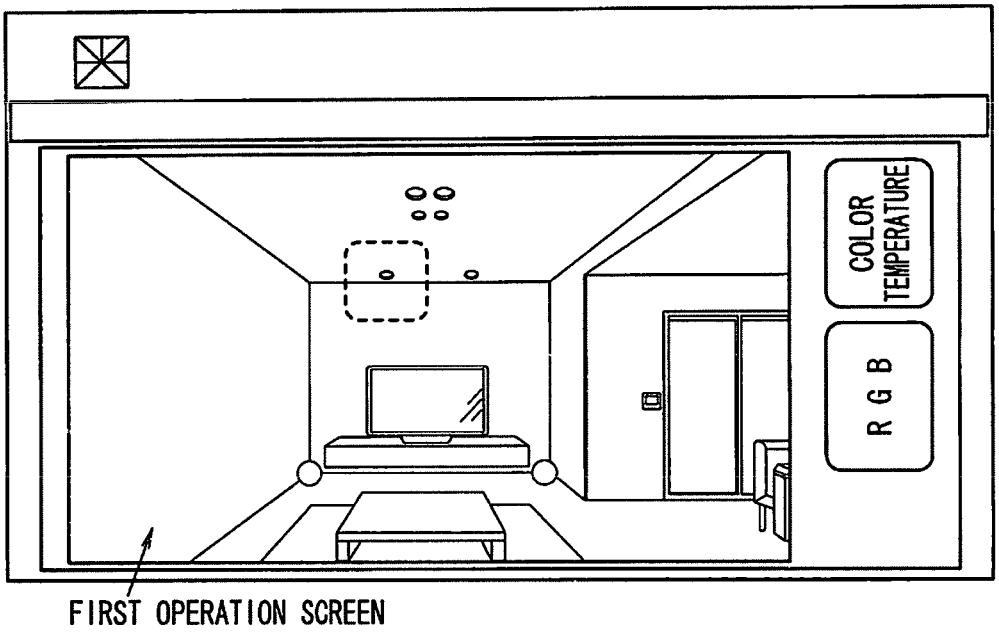
FIG. 4 is a diagram depicting a first operation screen displayed on the controller of the lighting system according to the embodiment of the present invention.

The display unit 31 of the controller 3 two-dimensionally or three-dimensionally displays a first operation screen which has a first graphic generated from the area information and the identification information of the lighting apparatuses 2, and a second operation screen which has a second graphic generated from the lighting information of the lighting apparatus 2. FIG. 4 shows an image when the display unit 31 displays the first operation screen three-dimensionally. If a control target lighting apparatus 2 is selected from among the lighting apparatuses 2 (of course, there is also a case where only a single lighting apparatus 2 is present) via the operation indication by the user on the first operation screen, the display unit 31 superposes the second operation screen, having the second graphic corresponding to the selected lighting apparatus 2, on the first operation screen for a dialog as illustrated in FIG. 5.

The information on the first graphic includes a one-point projected view of a lighting space as the area information, and a bit map or script (e.g. PostScript) that represents the design of one or more lighting apparatus(es), as the identification information of the lighting apparatus 2. The first graphic illustrated in FIG. 4 is a graphic placing the xyz coordinate system of the lighting apparatuses 2*a* to 2*h* in the lighting system 1 shown in FIG. 1 on the three-dimensional space of a room where the lighting apparatuses 2 are installed. The graphics disposed in the three-dimensional space of the room, that is the first graphic to represent the area information, includes not only the floor, wall and ceiling, but also a desk, shelf, household electronic appliances or the like. For these graphics, a still image captured by the user, for example, may be directly used. In concrete terms, the user captures, using a digital camera, a still image of the space where the lighting apparatuses 2 are installed, and loads this still image onto the controller 3 using various information transport terminals, a flash memory, for example, whereby the still image can be used as a graphic. A space image diagram, illustration of a shelf, furniture or the like, and a 3D CAD image data may be downloaded from the above mentioned external server 5, and used as a graphic. The first graphic representing the area information may be a later mentioned two-dimensional floor plan data, only if the image of the lighting space to be the control target can be navigated by the user, and in this case, the first graphic is a graphic arranging the lighting apparatuses 2 on the two-dimensional plane (floor plan). The data structure of the first graphic is not limited to the example mentioned above. For example, the first graphic to be the identification information of a lighting apparatus 2 is preferably a graphic drawn according to the size, shape or the like of the lighting apparatus 2.

Figure 5:
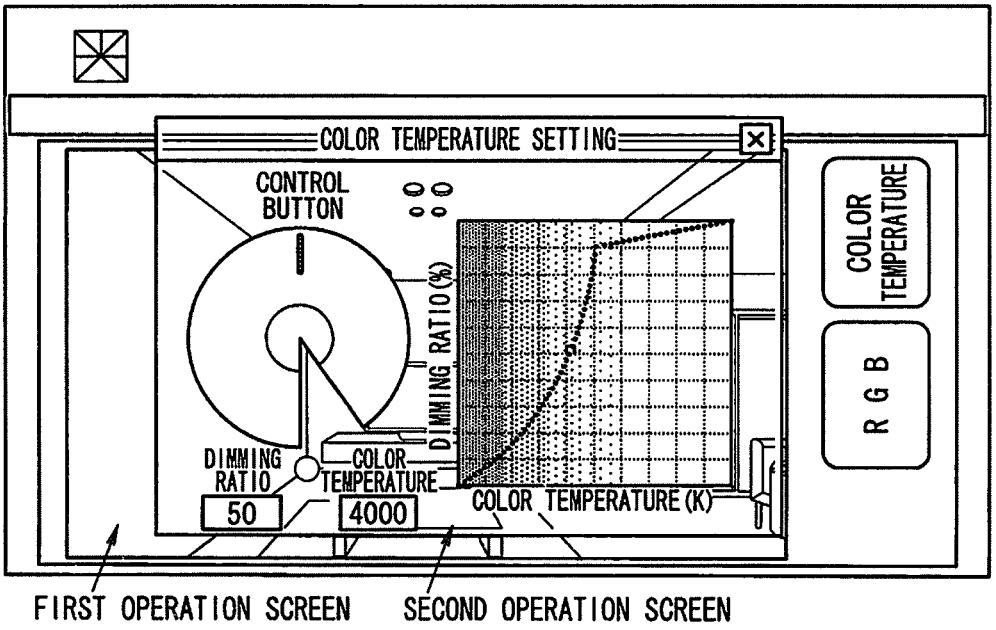
FIG. 5 is a diagram depicting a second operation screen superposed on the first operation screen displayed on the controller of the lighting system according to the embodiment of the present invention.

As illustrated in FIG. 5, the information on the second graphic is represented by the patterns that indicate an operation menu and menu items, for example. The second graphic is also a bit map, a script such as HTML and XML or the like, and the data structure thereof is arbitrary. The storage unit 32 may store a storage table in which the indication coordinates acquired for the second graphic and a plurality of pieces of attribute information are associated with each other. A detailed procedure of the operation indication using the second operation screen having the second graphic will be described later.

The configuration of a lighting apparatus 2 will be described with reference to FIG. 3 again. The lighting apparatus 2 includes a light source unit 21, a transmitting/receiving unit 22 that receives a control signal from the controller 3, and a control unit 23 that drives the light source unit 21 according to the lighting information included in the control signal received by the transmitting/receiving unit 22. The light source unit 21 is configured such that the color temperature of the irradiated light becomes variable by combining a plurality of types of luminous components, such as LEDs, having a different emission color respectively. The transmitting/receiving unit 22 transmits/receives data to/from the controller 3 or the regulator 4 via radio communication or cable communication. For the transmitting/receiving unit 22, a configuration corresponding to the transmitting/receiving unit 33 of the controller 3 is used.

In this example, the light source unit 21 has three-color light emitting elements (light emitting diodes) R, G and B that emit red (R), green (G) and blue (B). The three-color light emitting elements may be light emitting elements other than light emitting diodes, such as organic EL elements, inorganic EL elements, fluorescent lamps, HIDs, incandescent lamps or LED light bulbs. By changing the ratio of the light quantity YR, YG and YB of the light emitting elements R, G and B, the light color of the illumination light acquired by mixing these lights can be changed. If the light quantity YR, YG and YB are changed while maintaining the ratio of the light quantity YR, YG and YB, then the light quantity of the illumination light can be changed without changing the light color. The amount of luminescence of a light emitting diode is determined depending on the power feeding amount (current that flows through each light emitting element). This means that the light color and light quantity of the illumination light can be adjusted by increasing/decreasing the power feed amount (current) to be supplied from the control unit 23 to each light emitting element R, G and B. Furthermore, if the light quantity YR, YG and YB of each light emitting element R, G and B of the illumination light source are determined so that the chromaticity of the illumination light changes approximately along the black body locus, then the light color of the illumination light can be specified based on the color temperature.

Appropriate numbers of light emitting elements R, G and B used for the light source unit 21 are arranged in a package respectively, according to the size of these light emitting elements. The light source unit 21 may be designed as a module where a case and a light transmission panel are disposed on the edge. The material of the case is preferably material that does not easily break, for example a plastic, a composite material combining reinforced filler, such as glass fiber, with plastic, metal, such as an aluminum alloy, iron and a magnesium alloy, or wood, is used. For the above mentioned module, an appropriate number of modules are arranged in the lighting apparatus 2 according to the size of the apparatus 2. A configuration that allows adding on modules later may be used.

The control unit 23 includes a storage unit 23*a* that stores the identification information of a lighting apparatus 2 among others, a current converting unit 23*b* that converts AC voltage, such as a commercial power supply AC, into a desired DC voltage, a control signal converting unit 23*c* that interprets data from the transmitting/receiving unit and transfers the control signal, and a drive signal converting unit 23*d* that outputs a drive signal which is outputted to the light source unit 21.

The storage unit 23*a* is constituted by a general purpose microcomputer for lighting control and memory, and stores the identification information of a lighting apparatus 2, information on the related line in the system or the like. For example, information that is set by dip switches is stored. For the identification information of a lighting apparatus 2, identification information unique to the lighting apparatus, such as a global IP address and a MAC address, may be included.

The current converting unit 23*b* is constituted by a switch circuit, a transformer circuit and the like to supply a predetermined circuit. This current converting unit 23*b* may be replaced with a primary battery or a secondary battery, and a predetermined DC power may be supplied from the battery. This is suitable for the movable type lighting apparatuses 2*g* and 2*h* (see FIG. 1). The capacities of these batteries are selected according to the electric energy consumed by the lighting apparatus 2. The secondary battery may be configured such that a coil is mounted on a charger (power transmitting side) and a rechargeable battery (power receiving side) respectively, and power is transferred between the coils by non-contact electromagnetic induction, without using metal terminals. Then the battery can be recharged simply by being placed in the charger when a movable type lighting apparatus 2 is not used, which is convenient.

Figure 6:
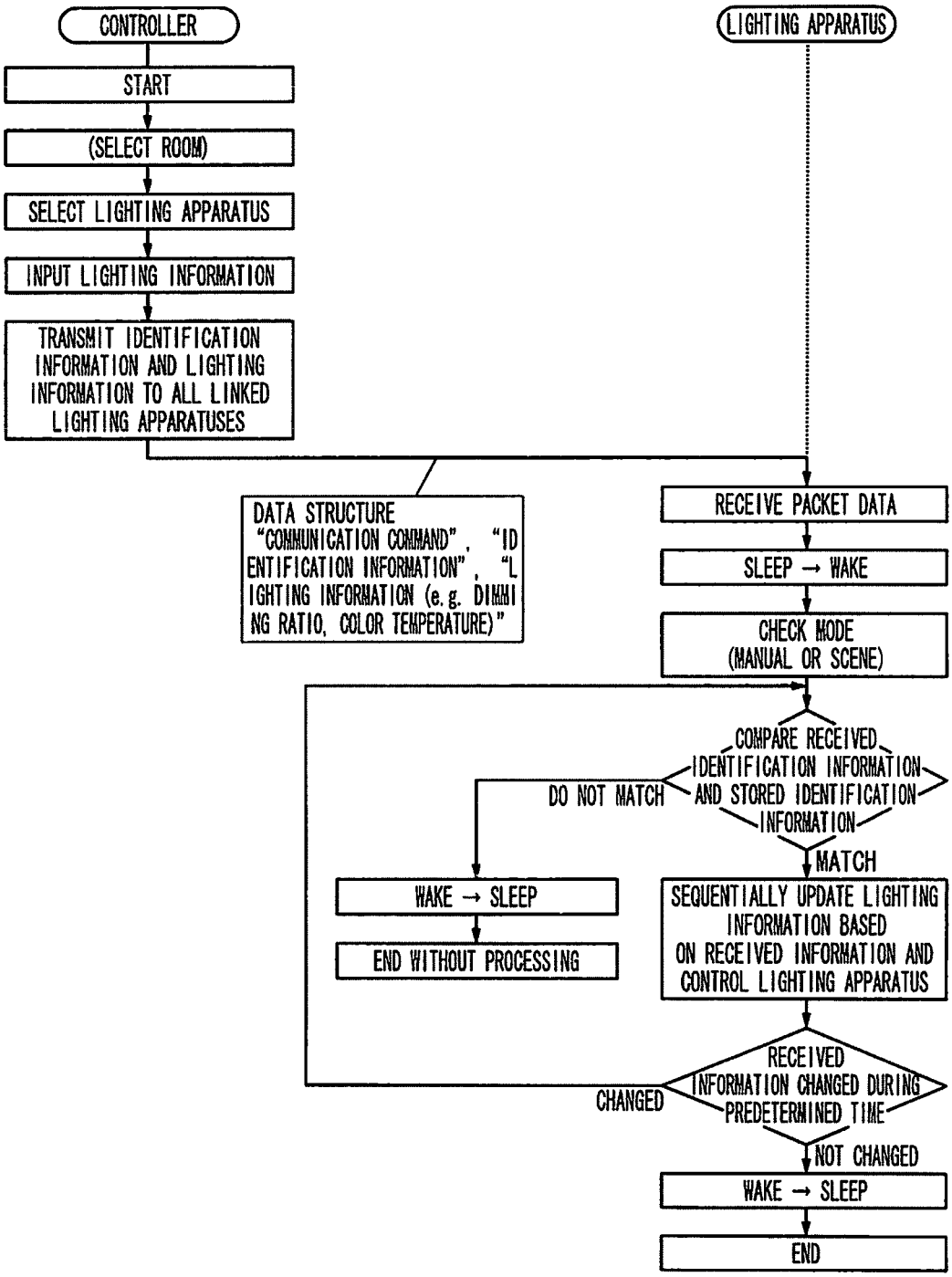
FIG. 6 is a flow chart depicting an example of data transmitting/receiving operation of the controller and the lighting apparatus in the lighting system according to the embodiment of the present invention.

The flow of the data transmission/reception performed between the controller 3 and the lighting apparatus 2 (lighting apparatus A or B in FIG. 3) will be described with reference to FIG. 6, in addition to the above mentioned FIG. 3. When a lighting apparatus 2 is selected and the lighting information of the lighting apparatus 2 is set in the operation unit (display unit 31), the controller 3 transmits the identification information and the lighting information to all the linked lighting apparatuses 2. In each lighting apparatus 2, on the other hand, the control signal converting unit 23*c* of the control unit 23 compares the identification information of the lighting apparatus 2 included in the control signal received by the transmitting/receiving unit 22, and the identification information of this lighting apparatus 2 stored in the storage unit 23*a*. The following processing is performed if each identification information match, and is not performed if there is no match.

If only one lighting information of the lighting apparatus 2, such as the dimming ratio information, is received from the transmitting/receiving unit 22 as the control signal, the control signal converting unit 23*c* converts the dimming ratio information as the control signal into a PWM signal duty ratio, and outputs it to a drive signal converting unit 23*d*. The drive signal converting unit 23*d* outputs a duty signal for driving and lighting the light source unit 21. If the received information changes within a predetermined time, the lighting apparatus compares the above mentioned signals and performs the same operation. If the received information is not changed during the predetermined time, the lighting apparatus enters sleep mode, and continuously lights the light source unit 21 based on a predetermined duty signal.

In concrete terms, if the lighting information of the lighting apparatus 2, included in the received information, is only one lighting information, such as the dimming ratio information, the control signal converting unit 23*c* converts the dimming ratio information as the control signal into the PWM signal duty ratio, and outputs it to the drive signal converting unit 23*d*. If the lighting information of the lighting apparatus 2, included in the received information, is two or more independent lighting information, such as the dimming ratio information and the color temperature information, the control signal converting unit 23*c* converts the dimming ratio information and the color temperature information as the control signal into a packet data signal, and outputs it to the drive signal converting unit 23*d*.

The configuration of the regulator 4 will be described with reference to FIG. 3 again. Just like the controller 3, the control unit 4 includes a display unit 41 that displays predetermined attribute information, a storage unit 42 that stores the attribute information, and a transmitting/receiving unit 43 that transmits/receives a control signal including attribute information to/from a lighting apparatus 2 and the controller 3. The display unit 41 is a touch panel, which integrates an operation unit that detects an operation indication. The regulator 4 also includes an input processing unit 44 that acquires coordinate information to indicate a position of the operation indication detected by the operation unit, and a control unit 45 that drives the display unit 41 or the like, and controls the transmission/reception of the control signal in the transmitting/receiving unit 43. The regulator 4 further includes a dimming signal output unit 46 that controls dimming of a lighting apparatus D which does not have a specific transmitting/receiving unit.

Figure 7:
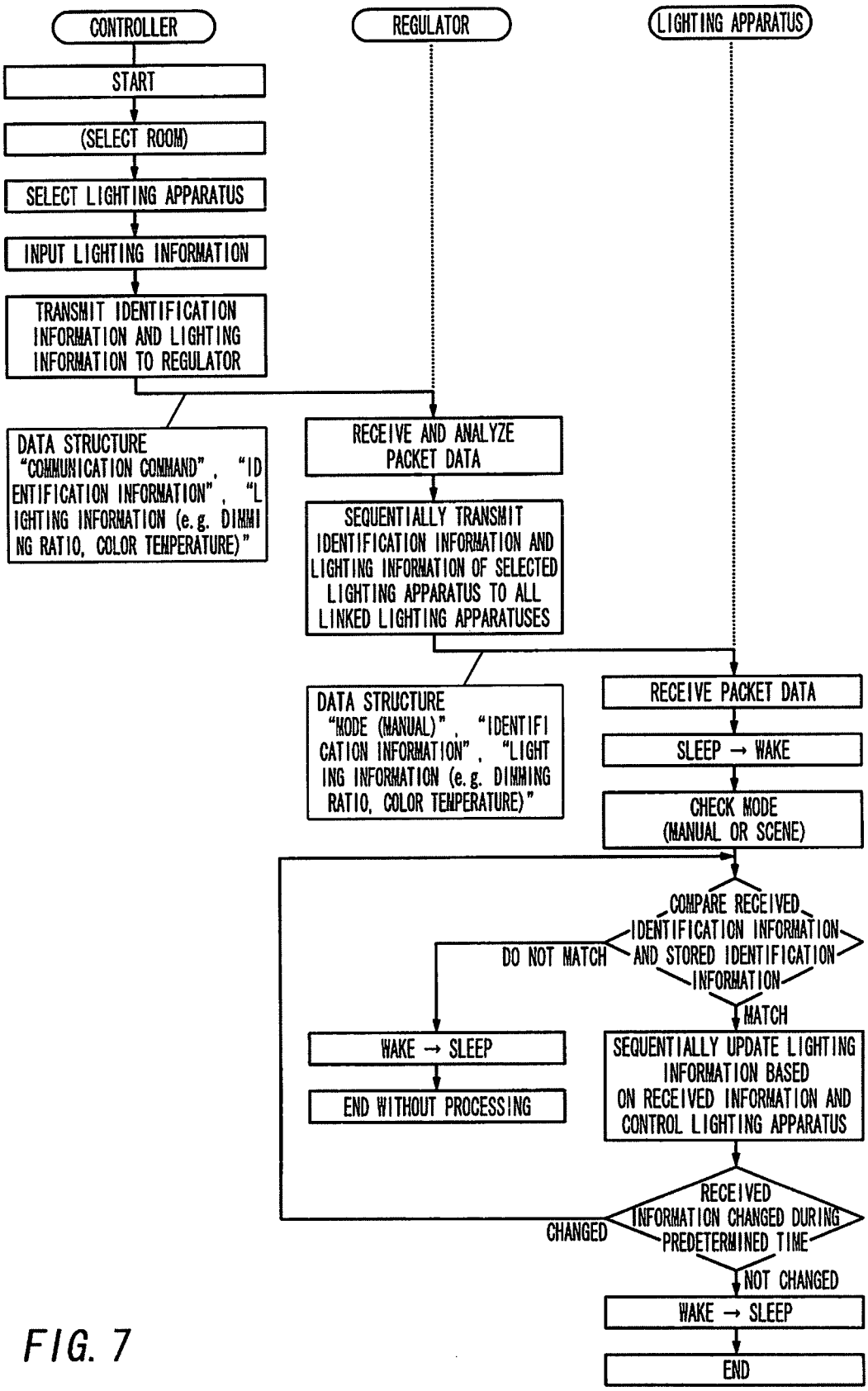
FIG. 7 is a flow chart depicting an example of data transmitting/receiving operation via a regulator in the lighting system according to the embodiment of the present invention.

Now a flow of the data transmission/reception performed between the controller 3 and the lighting apparatus 2 (lighting apparatus B or C in FIG. 3) via the regulator 4 will be described with reference to FIG. 7, in addition to the above mentioned FIG. 3. In this flow, the regulator 4 transmits identification information and lighting information to all the linked lighting apparatuses 2. All the lighting apparatuses 2 may be linked, or only predetermined lighting apparatuses 2 may be linked. The rest of the operation is the same as the flow depicted in FIG. 6. The flow depicted in FIG. 7 can be applied to a case when the lighting of the lighting apparatus B can also be controlled by the conventional regulator 4, or a case when the lighting apparatus C is connected with the regulator 4 by cable.

Figure 8:
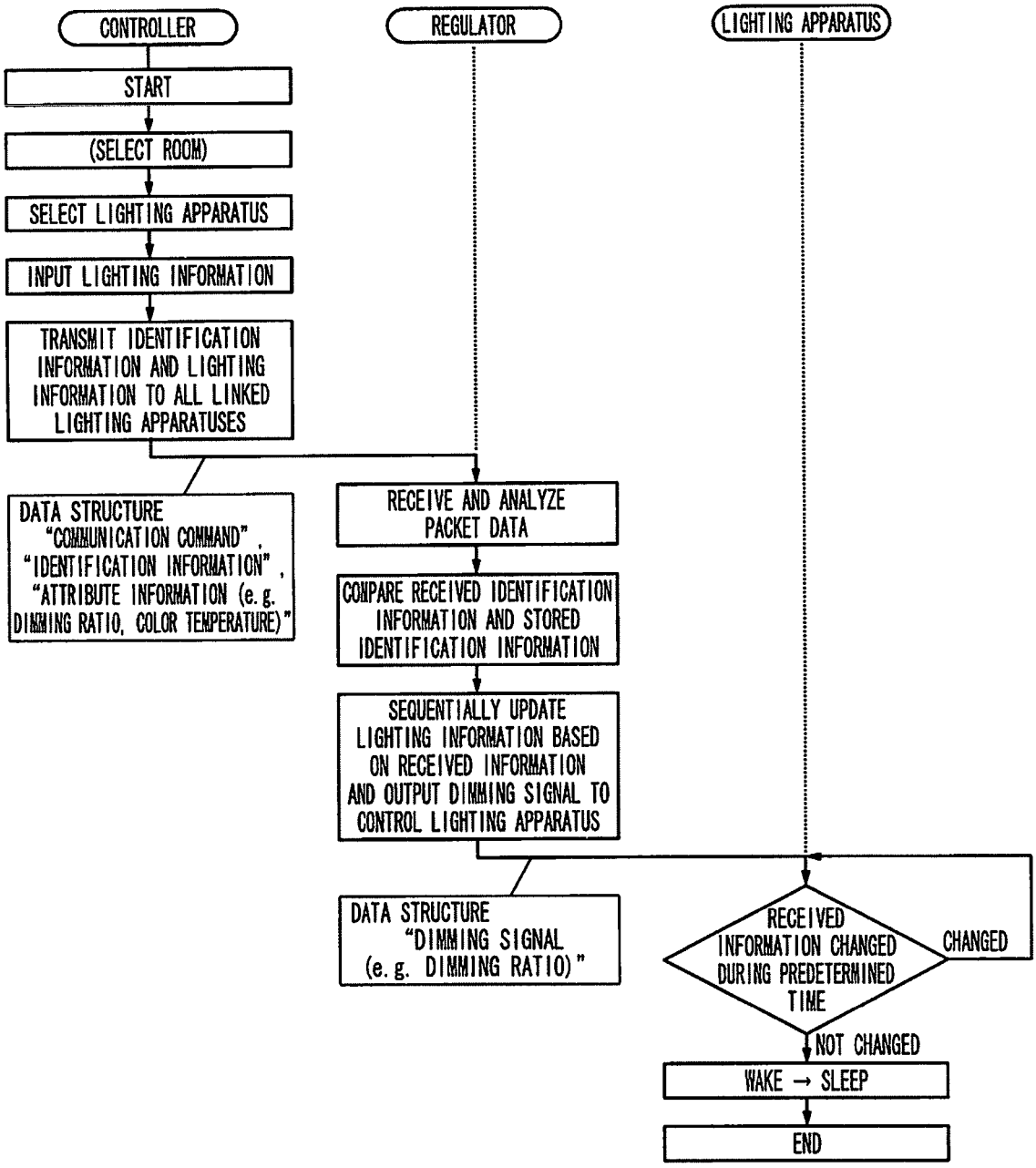
FIG. 8 is a flow chart depicting another example of data transmitting/receiving operation via a regulator in the lighting system according to the embodiment of the present invention.

Now a flow of the data transmission/reception performed between the controller 3 and the lighting apparatus 2 (lighting apparatus D in FIG. 3) via the regulator 4 will be described with reference to FIG. 8, in addition to the above mentioned FIG. 3. In the flows depicted in FIG. 6 and FIG. 7, the lighting apparatus 2 compares the identification information of the lighting apparatus 2 included in the control signal received by the transmitting/receiving unit 22 and the identification information of the lighting apparatus stored in the storage unit 23*a*. Whereas in the flow depicted in FIG. 8, the regulator 4 performs this comparison, and a dimming signal output unit 46 of the regulator 4 outputs a predetermined dimming signal directly to a specific lighting apparatus D connected via cable. In other words, the lighting apparatus D is a conventional type lighting apparatus which does not have a specific communication terminal (transmitting/receiving unit) and an advanced control unit for comparing various control information, and turns the light source unit 210N according to the dimming ratio inputted by a conventional dimmer.

Figure 9:
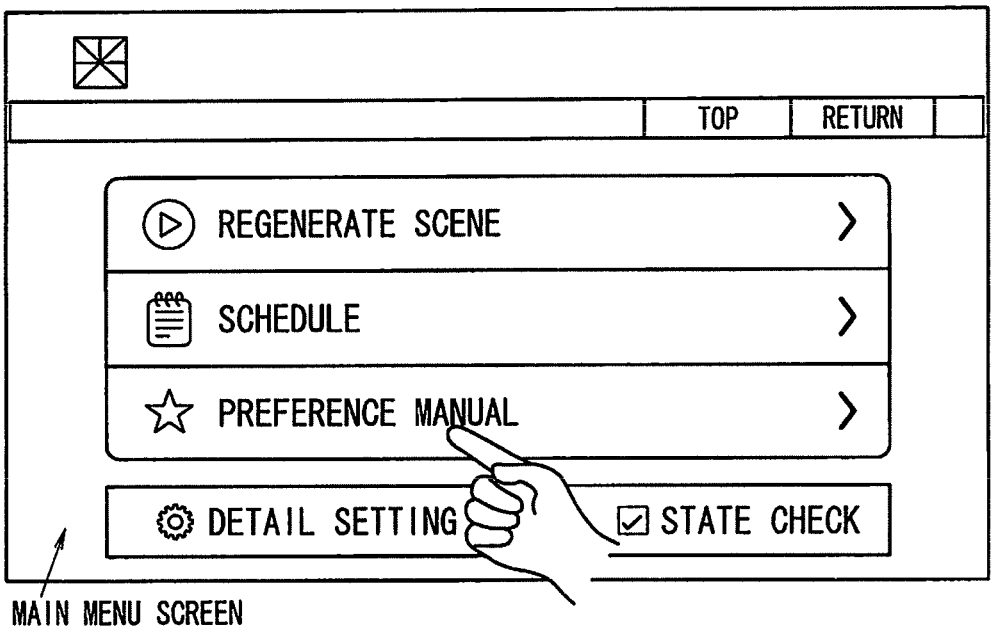
FIG. 9 is a diagram depicting a main menu screen displayed on the controller of the lighting system according to the embodiment of the present invention.

Now a procedure to set the lighting conditions of the lighting apparatus 2 using the controller 3 in the lighting system 1 will be described with reference to FIG. 9 to FIG. 13. Here an example of manually setting the lighting conditions preferred by the user for a specific lighting apparatus 2 will be described. When the user starts up the built-in software for the lighting system by operating the controller 3, a menu screen as illustrated in FIG. 9 is displayed on the display unit 31 of the controller 3. On the main menu screen, "Regenerate Scene", "Schedule" and "Preference Manual" are displayed as the main commands, and "Detail Setting" and "State Check" are displayed as sub-commands.

Figure 10:
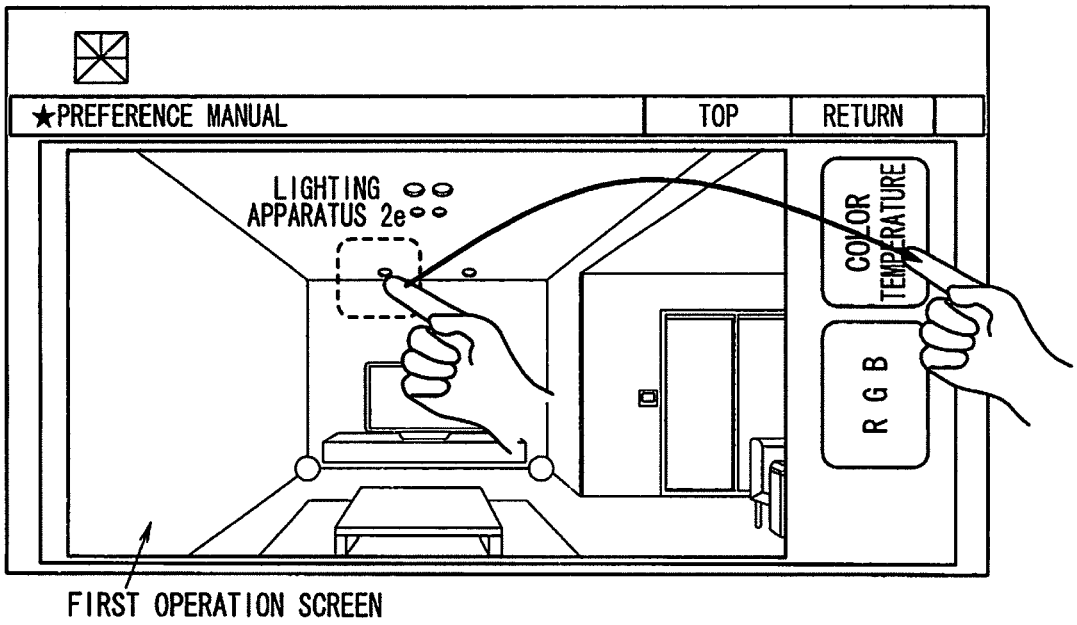
FIG. 10 is a diagram depicting a first operation screen displayed on the controller of the lighting system according to the embodiment of the present invention.

If the user touches the "Preference Manual" command with a finger, the display unit 31 displays the first operation screen as illustrated in FIG. 10. On the first operation screen, a first graphic where the xyz coordinate system of the lighting apparatuses 2*a* to 2*h* in the lighting system 1, illustrated in FIG. 1, is disposed on the three-dimensional space of the room in which the lighting apparatuses 2 are arranged, a "Color Temperature" button for setting the dimming ratio and the color temperature of the lighting apparatus 2, and an "RGB" button for setting chromaticity or the like of the RGB system, are displayed.

If the user touches an image representing a control target lighting apparatus 2 on the display unit 31 (operation unit) where the first operation screen is displayed, this lighting apparatus 2 is enclosed by a frame line. At this time, characters to indicate the identification information of the lighting apparatus 2 (a name, in the case of this example) may be displayed near the frame line as a pop-up display. If the user touches the "Color Temperature" button next, the lighting apparatus 2 enclosed by the frame line is specified as the control target. If the lighting apparatus 2 enclosed by the frame line is touched again before touching the "Color Temperature" button, the frame line disappears, and the specification of the lighting apparatus 2 is cleared.

Figure 11:
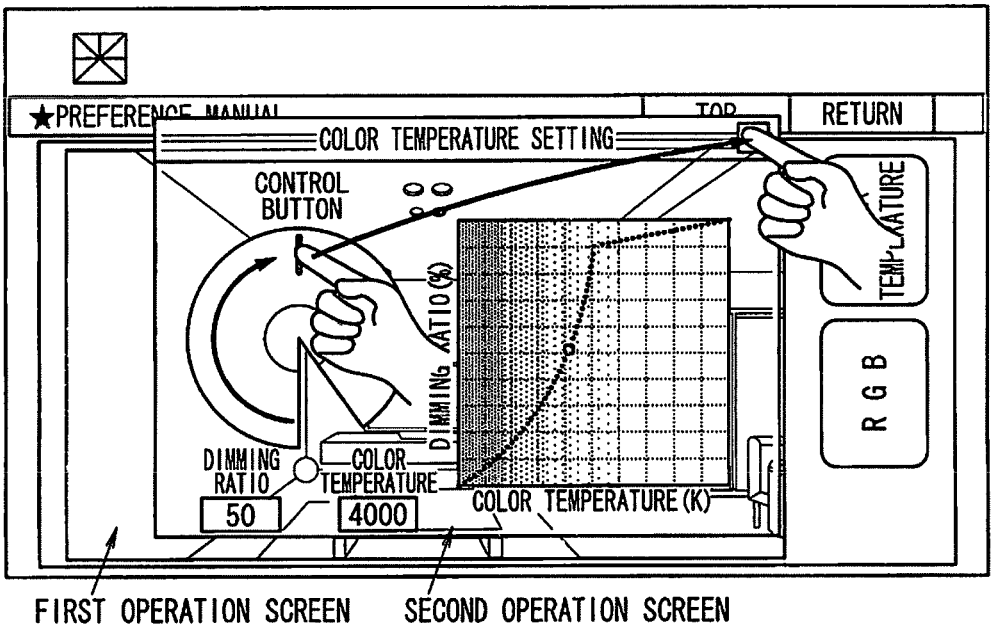
FIG. 11 is a diagram depicting a second operation screen (color temperature setting) superposed on the first operation screen displayed on the controller of the lighting system according to the embodiment of the present invention.

If the control target lighting apparatus 2 is specified, the display unit 31 displays a second operation screen for setting the lighting information of this lighting apparatus 2 as a dialog superposed on the first operation screen as illustrated in FIG. 11. On the second operation screen, a "Control" button imaging the rotation type volume controller and a color temperature table, where a dimming/toning curve that associates the dimming ratio and the color temperature with each other is drawn, are displayed as a second graphic. Further, on the second operation screen, a title bar, for displaying a title name that is set, and a button for closing to exit the second operation screen, are displayed. Here the color temperature table (second graphic) where the dimming/toning curve associating together two pieces of lighting information, such as the dimming ratio and the color temperature, is used as an example, but the second operation screen is not limited to this. For example, if a lighting apparatus 2 in which the light irradiation range is variable is used, lighting information other than the above, such as the lighting beam angle, may be associated with the above lighting information (dimming ratio and color temperature).

Figure 12:
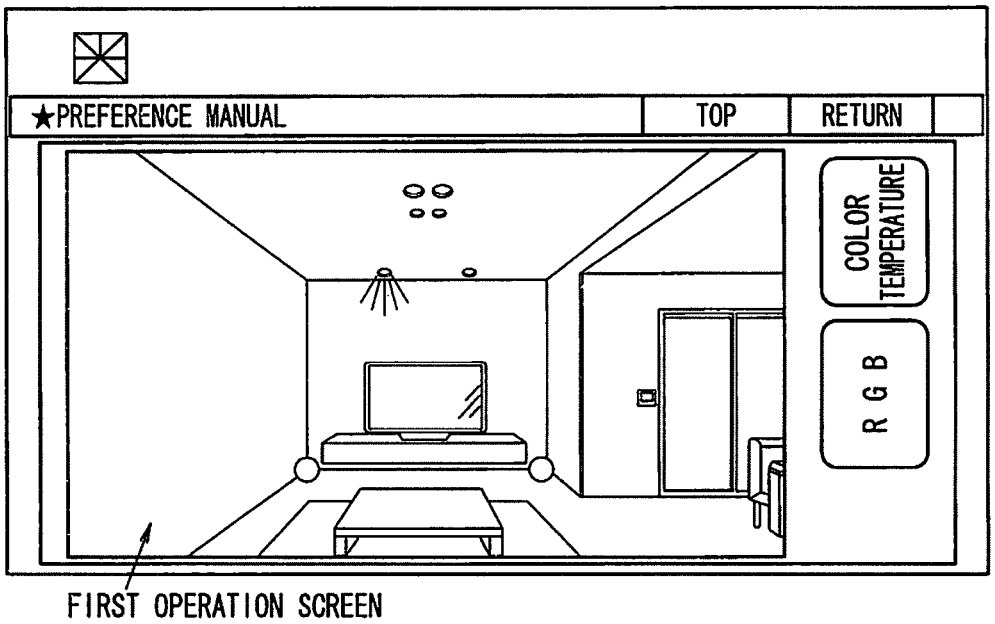
FIG. 12 is a diagram depicting the first operation screen displayed on the controller of the lighting system according to the embodiment of the present invention.

If the user performs a touch operation so as to rotate the control button on the display unit 31 (operation unit) where the second operation screen is displayed, the lighting information, such as the dimming ratio and the color temperature of the specified lighting apparatus 2 changes following the dimming/toning curve drawn on the color temperature table. If the user stops the touch operation of rotating the control button, the dimming ratio and the color temperature at this time are set as the lighting information of the specified lighting apparatus 2. Then if the user closes the second operation screen as illustrated in FIG. 12, the display unit 31 highlights the image of the specified lighting apparatus 2 on the first operation screen as if the lighting apparatus 2 were lighting at the dimming ratio and the color temperature setting for the lighting apparatus 2. In this case, the display unit 31 not only highlights the image of the lighting apparatus 2, but also the area information that corresponds to the area around the lighting apparatus 2. In other words, the lighting information that is set on the second operation screen is visually reflected on the first operation screen.

Figure 13:
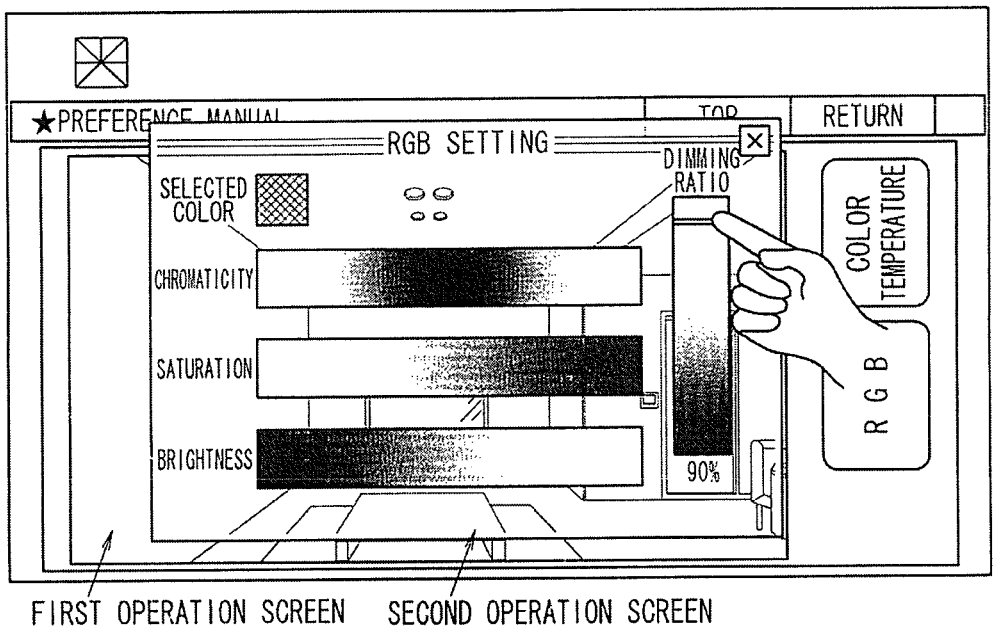
FIG. 13 is a diagram depicting the second operation screen (RGB setting) superposed on the first operation screen displayed on the controller of the lighting system according to the embodiment of the present invention.

If the user touches the "RGB" button on the first operation screen, illustrated in FIG. 10, the display unit 31 displays a second operation screen for setting chromaticity or the like based on the RGB system, so as to be superposed on the first operation screen as illustrated in FIG. 13. The second operation screen includes as a second graphic, an illumination light color (selected color) display field selected by the user, horizontal bars for color-displaying chromaticity, saturation and brightness respectively, and a vertical bar for displaying the dimming ratio of the lighting apparatus 2. Also on the second operation screen, if the user touches a portion where the horizontal bars and the vertical bar are displayed, chromaticity or the like of that portion is set. When the second operation screen is closed, the lighting information, such as the chromaticity that is set, is reflected on the image of the lighting apparatus 2 and on the peripheral area displayed on the first operation screen. On the second operation screen, each parameter of chromaticity, for example, or the like is color-displayed, hence the user can set the chromaticity of the illumination light more intuitively than the case of by numerical indication for example. Further, many parameters (lighting information) are displayed on the second operation screen in one batch, hence each lighting information can be individually set according to the preference of the user. Furthermore, hue in the area around the lighting apparatus 2 also changes on the first operation screen after closing the second operation screen, responding to the lighting information of the lighting apparatus 2, hence the user can more concretely imagine the space created by the lighting.

Thus according to the lighting system 1, the area information, including the area where the lighting apparatuses 2 are installed, is displayed three-dimensionally on the first operation screen by the display unit 31 of the controller 3, and then the second operation screen for setting the lighting information for each lighting apparatus 2 is displayed on the first operation screen as a dialog. If the lighting information is set, the identification information of the lighting apparatus and the area information of the peripheral area thereof are highlighted on the first operation screen. This allows the user to imagine a space (target area) where the control target lighting apparatus 2 is installed, hence a general user can intuitively select the control target lighting apparatus 2, and set the lighting attribute information, such as the lighting state, with good operability.

The lighting information and the identification information of the lighting apparatus 2, which are set by the controller 3, are incorporated into the control signal which is outputted from the controller 3, and this control signal is outputted to each lighting apparatus 2 directly or via the regulator 4. The lighting apparatus 2 reads the lighting information from the received control signal according to the flows depicted in FIG. 6 to FIG. 8, and lights the light source unit 21 based on this lighting information. Thereby the lighting information of the lighting apparatus 2 virtually displayed on the controller 3 is implemented in the actual lighting apparatus 2.

Figure 14:
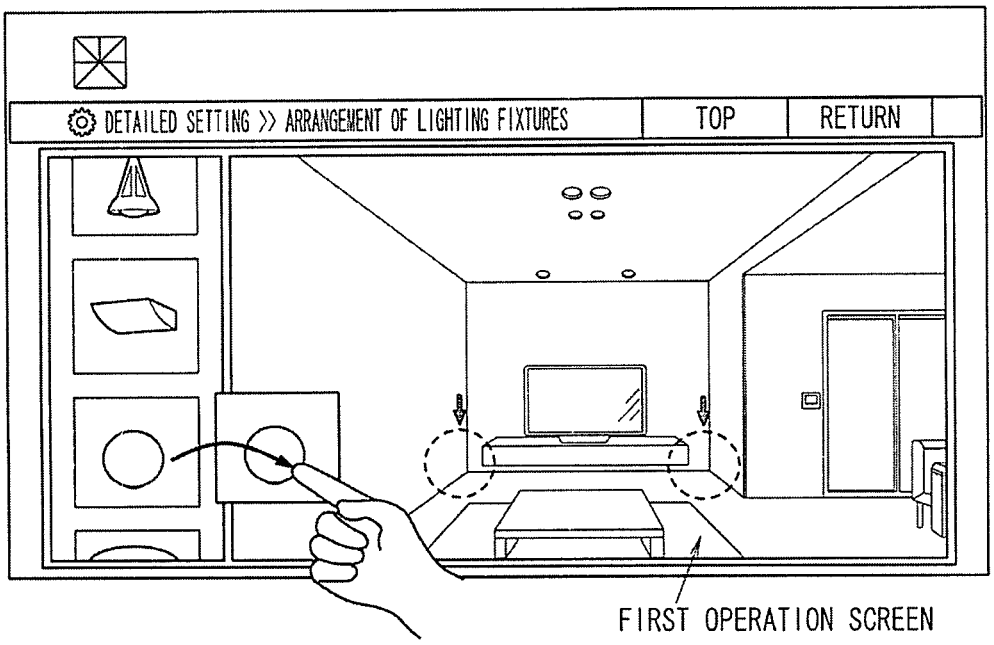
FIG. 14 is a diagram depicting an operation example to add a lighting apparatus on the first operation screen displayed on the controller of the lighting system according to the embodiment of the present invention.
Figure 15:
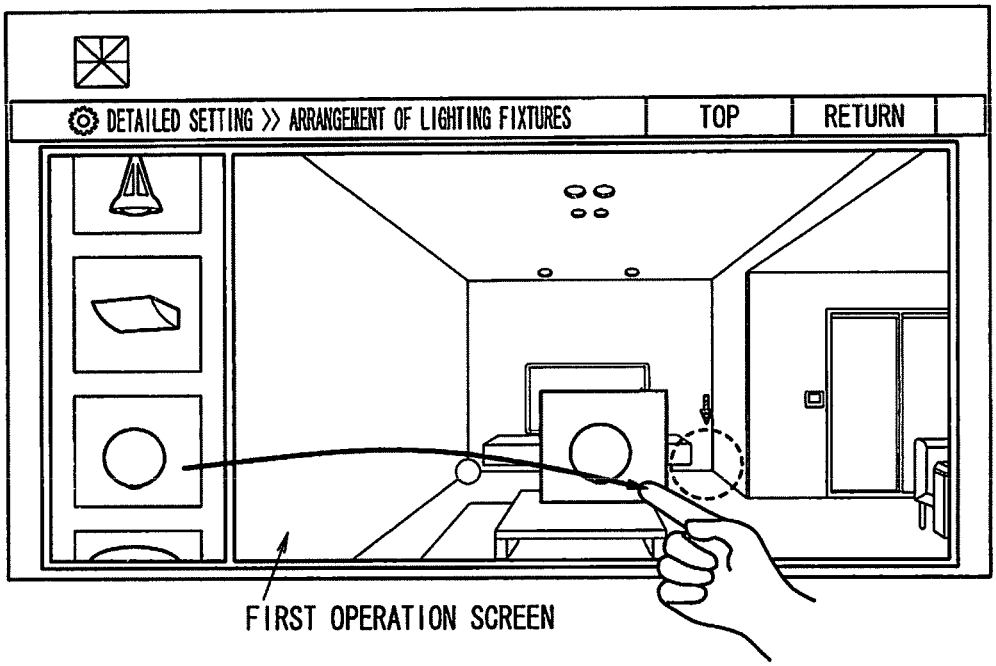
FIG. 15 is a diagram depicting an operation example to add a lighting apparatus on the first operation screen displayed on the controller of the lighting system according to the embodiment of the present invention.
Figure 16:
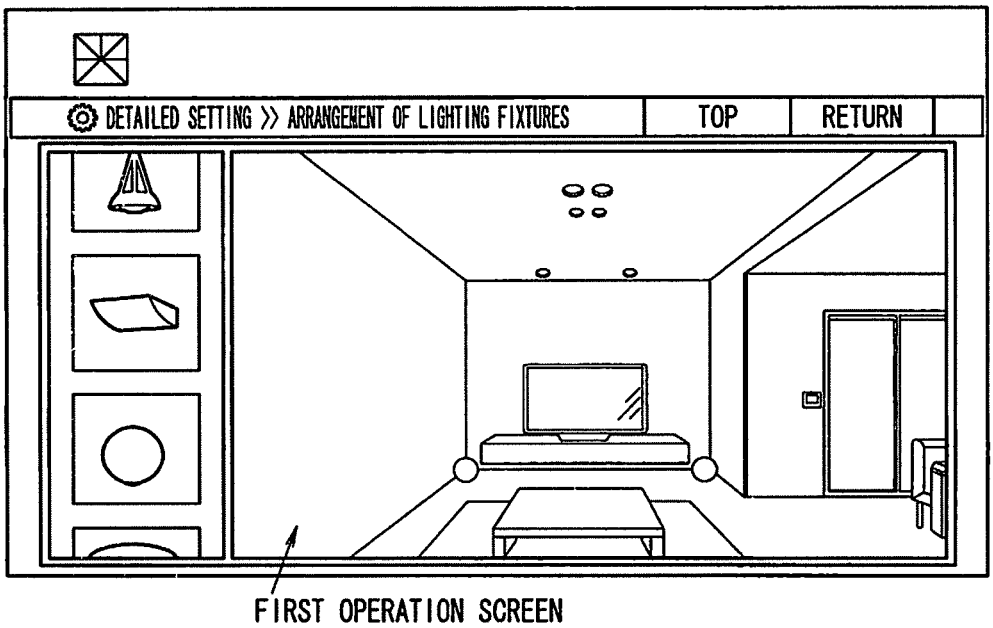
FIG. 16 is a diagram depicting an operation example to add a lighting apparatus on the first operation screen displayed on the controller of the lighting system according to the embodiment of the present invention.

Now a procedure to add a new lighting apparatus 2 in the lighting system 1 will be described with reference to FIG. 14 to FIG. 16. If the user touches the "Detailed Setting" command with a finger in the sub-command field on the main menus screen illustrated in FIG. 9, the display unit 31 switches the screen to a detailed setting menu screen (not illustrated). The detailed setting menu screen includes a field to select the "Set Room and Lighting Fixtures" and "Set Lighting Scene", and if the user touches "Set Room and Lighting Fixture", the screen switches to an area selection screen (not illustrated) for selecting an area, such as the living/dining room and entrance hall. FIG. 14 is a first operation screen for setting the arrangement of the lighting fixtures, which is displayed when the user selects "Living/Dining Room" as a target area on the area selection screen. On this first operation screen, the above mentioned first graphic (area information and identification information of the lighting apparatus) and a graphic (identification information) to indicate other lighting apparatuses 2 which are not installed in the first graphic setting area (target area).

A graphic of other lighting apparatus 2 is iconized and displayed outside the first graphic (called the "indoor image field" here) that indicates the area information. The iconized graphic indicating other lighting apparatus 2 can be downloaded from the external sever 5 shown in FIG. 3 to the storage unit 32 of the controller 3, and if there are many such iconized lighting apparatuses, the user can select the graphics indicating all the lighting apparatuses 2 in the storage unit 32 by scrolling the display space on the first operation screen with a finger.

When a graphic (icon) indicating other lighting apparatus 2, which is displayed outside the indoor image field, is selected and the coordinate information of this icon of the selected other lighting apparatus 2 moves to the indoor image field, the graphic (identification information) of this selected other lighting apparatus is displayed in a predetermined position inside the indoor image field. The position coordinate of this added lighting apparatus 2 is recorded in the storage unit 32. In other words, if the icon of this other lighting apparatus 2 displayed outside the indoor image field is dragged and dropped into a predetermined position inside the indoor image field (e.g. an area indicated by the broken lined circle), the graphic indicating this lighting apparatus 2 is displayed in the indoor image field, as illustrated in FIG. 14 and FIG. 15. By repeating this operation, a plurality of lighting apparatuses 2 can be dragged into the indoor display field, as illustrated in FIG. 16.

When the graphic (identification information) of a lighting apparatus 2 inside the indoor image field is selected, and the coordinate information of the icon of the selected lighting apparatus 2 is moved in the indoor image field, the storage unit 32 updates the position information of the selected lighting apparatus 2 based on the coordinate information after the movement. Then the display unit 31 displays only the graphic indicating the updated position information of the lighting apparatus 2. In other words, if an icon of a lighting apparatus 2 displayed inside the indoor image field is dragged and dropped into a predetermined position in the indoor image field, this icon moves in the indoor image (not illustrated). If an icon of a lighting apparatus 2 displayed in the indoor image is dragged and dropped outside the indoor image, then this icon can be deleted.

As described above, according to the lighting system 1, the display unit 31 of the controller 3 virtually displays the lighting apparatus 2 and a space in which the lighting apparatus 2 is installed, therefore the user can intuitively update information relevant to the lighting apparatus 2 stored in the lighting system 1, by adding, moving or deleting the virtually displayed lighting apparatus 2. If the user touches the "Top Page" button and closes the first operation screen for setting the arrangement of the lighting fixtures, the position coordinates of each lighting apparatus 2 are determined. Then if the first operation screen illustrated in FIG. 10 is opened, the graphic indicating the lighting apparatus 2 added or moved or deleted by the above procedure is displayed, and the lighting information on the added or moved or deleted lighting apparatus 2 can be set by expanding the second operation screen according to the procedure shown in FIG. 11 and FIG. 12. The lighting information that is set is visually reflected on the first screen information.

In a general residence, there are not only fixed type lighting apparatuses which are installed during construction of the residential building, but also includes lighting apparatuses 2 which are placed on the floor or on a shelf and suitably moved, and lighting apparatuses 2 which are added when necessary, and setting of the lighting attribute information on such lighting apparatuses 2 must be changed when necessary. According to the above mentioned lighting system 1, a general user can intuitively select a control target lighting apparatus 2 in a target area where the lighting apparatuses 2 are installed, and can set the lighting information thereof with good operability, and can easily change setting when a lighting apparatus 2 is moved or added.

Figure 17:
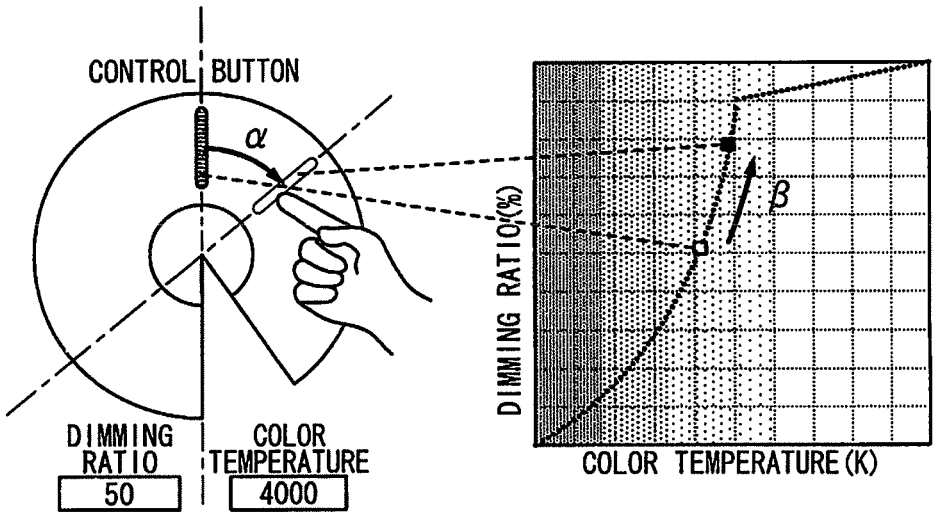
FIG. 17 is a diagram depicting a second graphic in which lighting information on the dimming ratio and lighting information on the color temperature are set in association with each other on the second operation screen displayed on the controller of the lighting system according to the embodiment of the present invention.
Figure 18A:
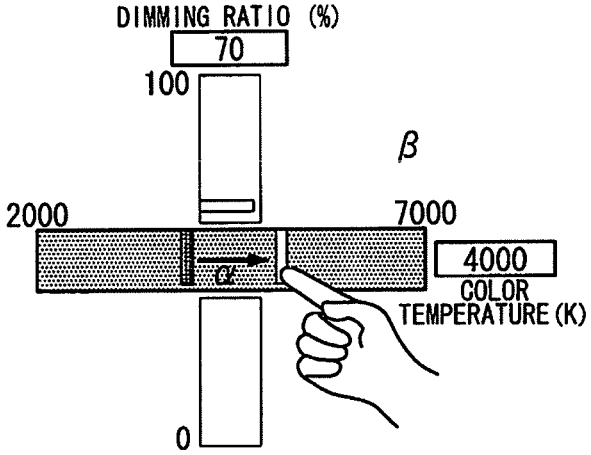
FIG. 18A to FIG. 18C are diagrams depicting a second graphic in which lighting information on the dimming ratio and lighting information on the color temperature are set independently on the second operation screen displayed on the controller of the lighting system according to the embodiment of the present invention.
Figure 18B:
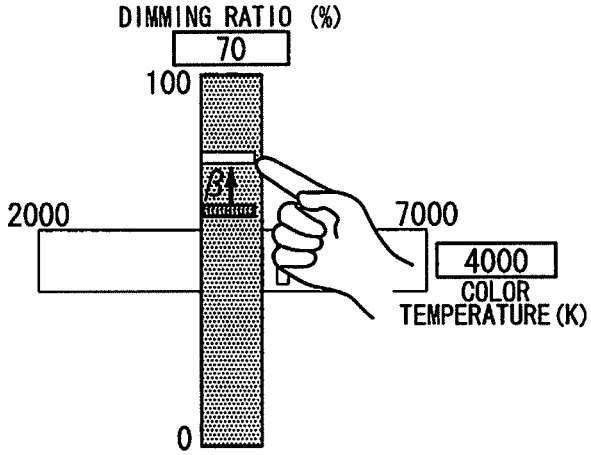
Figure 18C:
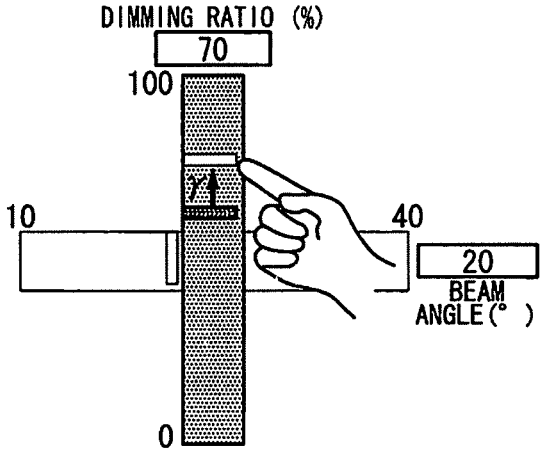
Figure 19:
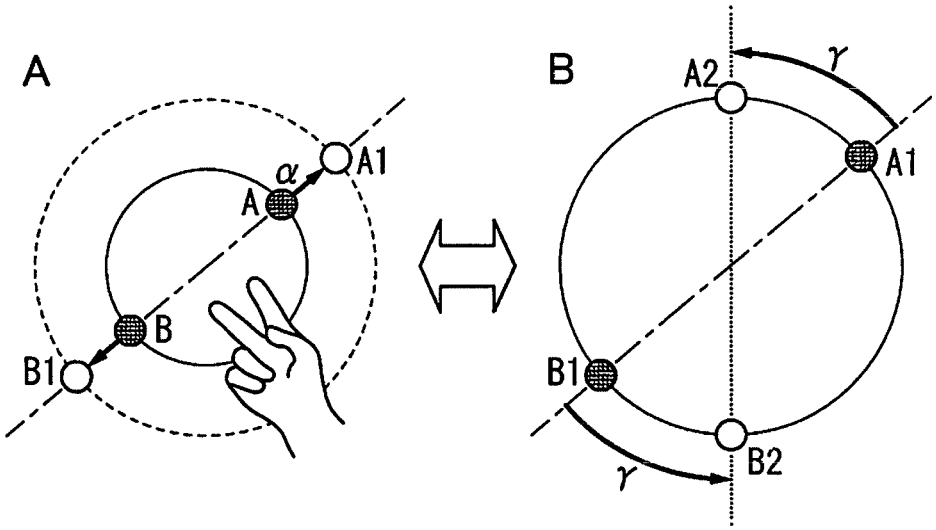
FIG. 19 is a diagram depicting an example of inputting operation indication information to zoom in/zoom out of the display on the first operation screen displayed on the controller of the lighting system according to the embodiment of the present invention.

A procedure of setting the dimming ratio and the color temperature illustrated in FIG. 11 will be described in more detail with reference to FIG. 17 to FIG. 19. FIG. 17 shows the same content as the second graphic displayed on the second operation screen illustrated in FIG. 11. Here the second graphic is a circular control button, and if the touch of the users finger (operation indication) moves rotationally around the center point of the circle of the control button in the second operation screen, the controller 3 changes the lighting information that is set according to the rotation angle thereof. Here correspondence may be carried out by setting the rotation angle $\alpha$ of the control button and the length $\beta$ of the dimming/toning curve to be a predetermined ratio. The correspondence may also be carried out by setting the rotation angle $\alpha$ of the control button and the variation width of the dimming ratio to be a predetermined ratio, or by setting the rotation angle $\alpha$ of the control button and the variation width of the color temperature to be a predetermined ratio.

On the second operation screen, the dimming ratio and the color temperature change according to the dimming/toning curve drawn on a color temperature table. It is known that there is a law called the Kruzof effect between the color temperature and the illuminance of an illuminated light. According to this law, when the color temperature of the light is low, a calm and warm impression is given if the illuminance is low, but a stuffy and discomforting impression is given if the illuminance is higher than a predetermined level. When the color temperature of the light is high, a fresh, sharp and comfortable impression is given if the illuminance is high, but a cold, gloomy discomforting impression is given if the illuminance is low. The Kruithof curve is also known which defines the relationship between the illuminance and the color temperature so that the most comfortable color temperature is acquired for each illuminance. In the Kruithof curve, the change of the dimming ratio with respect to the change of the color temperature is small in the low color temperature range (3000 K or less), and the change of the dimming ratio with respect to the change of the color temperature increases as the range moves to the intermediate color temperature range (about 3000 to 5000 K). The change of the color temperature with respect to the change of the dimming ratio becomes high in the high color temperature range (5000 K or more).

If the Kruithof curve is used as the dimming/toning curve of the color temperature table, the dimming ratio and the color temperature that gives comfort are automatically set only if the user performs the touch operation to rotate the control button on the second operation screen. The Kruithof curve is an example of a dimming/toning curve, and the dimming/toning curve (straight line) may be set so that the dimming ratio and the color temperature are in direction proportion to each other, for example. A dimming/toning curve may be set such that the change of the dimming ratio with respect to the change of the color temperature is large in the low color temperature range, and the change of the dimming ratio with respect to the change of the color temperature becomes small from the intermediate color temperature range to the high color temperature range. These dimming/toning curves are stored in the storage unit 32 of the controller 3, or a dimming/toning curve suitable for the intended use may be downloaded from the external server 5 shown in FIG. 3, or the user themselves may independently set a dimming/toning curve. If the rotation angle $\alpha$ of the control button and the variation width of the dimming ratio or the color temperature are corresponded to be a predetermined ratio, then if one of the dimming ratio and the color temperature is selected, the other of the color temperature information and the dimming ratio information is automatically selected according to the dimming/toning curve, hence the number of times of operation decreases and user friendliness improves.

FIG. 11 shows the second operation screen where the dimming ratio and the color temperature can be set by a single operation. FIG. 17, on the other hand, shows the second operation screen to individually set the dimming ratio, color temperature and other lighting information. As illustrated in FIG. 18A to FIG. 18C, rectangular bars (second graphic) are displayed on the second operation screen in the horizontal direction and the vertical direction forming a cross-pattern. In FIG. 18A and FIG. 18B, a color temperature bar is displayed in the horizontal direction and a dimming ratio bar is displayed in the vertical direction, and a scroll bar is displayed in each bar. When an operation indication by the user linearly moves along the longitudinal direction of each bar (second graphic) on the second operation screen, the controller 3 selects the lighting information according to the moving distance. In concrete terms, if the user touches inside the area of the color temperature bar, the color temperature bar is displayed in bold in front of the dimming ratio bar, as illustrated in FIG. 18A. If the user moves the scroll bar in the color temperature bar in this state, the color temperature is set based on the moving distance a of the scroll bar with respect to the length of the bar. If the user touches inside the area of the dimming ratio bar, the dimming ratio bar is displayed in bold in front of the color temperature bar, as illustrated in FIG. 18B. If the user moves the scroll bar in the dimming ratio bar in this state, the dimming ratio is set based on the moving distance $\beta$ of the moved scroll bar.

The second graphic displayed on the second operation screen is set according to the configuration, intended use or the like of the lighting apparatus 2. For example, the control button and the color temperature table are used as the second graphic, as illustrated in FIG. 17, if the lighting apparatus 2 is used in a living room of a general residence and if the comfort of illumination light is required. The color temperature bar and the dimming ratio bar are used as the second graphic, as illustrated in FIG. 18A and FIG. 18B, if the lighting apparatus 2 is used in a store and various lighting effects are required. The color temperature displayed in the horizontal direction and a beam angle bar displayed in the vertical direction are used as the second graphic, as illustrated in FIG. 18C, if the lighting apparatus 2 can change the dimming ratio and the irradiation range (beam angle) of the illumination light, as in the case of a spot light in a show room. Just like the example in FIG. 17, the changes in these pieces of lighting information may be associated with each other. For example, the data table determining the correspondence can be stored in the storage unit 32 such that if the user increases the dimming ratio on the second operation screen in FIG. 18C, the beam angle automatically decreases.

Now different patterns of the operation indication by the user performed on the display unit 31 (operation unit) of the controller 3, other than the above mentioned pattern, will be described. One pattern is, as illustrated in FIG. 19A, the user inputting two points of the indication coordinates A and B as the operation indication using two fingers on the display unit 31 (operation unit), and changing the distance between these indication coordinates to the indication coordinates A1 and B1. When this operation indication is performed, the controller 3 selects predetermined lighting information according to the distance between the indication coordinates. Another pattern is, as illustrated in FIG. 19B, the user inputting two points of indication coordinates A1 and B1 as the operation indication using two fingers on the display unit 31 (operation unit), and rotating the segment connecting these indication coordinates so that the indication coordinates become A2 and B2. If this operation indication is performed, the controller 3 selects predetermined lighting information according to the rotation angle of the segment between the indication coordinates.

The operation indication patterns are suitably used for setting the lighting information of a lighting apparatus 2 that can change the irradiation range (beam angle) and the optical axis of the illumination light. For example, if an operation indication to increase a distance between the indication coordinates A and B is performed, as illustrated in FIG. 19A, the controller 3 sets a large beam angle for the lighting apparatus 2. In concrete terms, the storage unit 32 of the controller 3 stores the relational table to show the relationship of the distance between the indication coordinates and the beam angle information. Here the controller 3 is designed to compute recommended beam angle information from the distance between two indication coordinates which are inputted and the position information and the light distribution information of the lighting apparatus 2. In this example, two points of indication target point graphics (white circles), direction graphics (arrow marks) to move two fingers, and a circle graphic (dotted line) are simultaneously displayed by the display unit 31, and a beam angle recommended to the user is navigated. Display of the indication target point graphics and the direction graphics for navigation are deleted when the touch operation position by the user reaches the two target indication points on the screen. Then when the user releases their fingers from touching the two points, the controller 3 determines the indication coordinates of the two points, and determines the beam angle of the attribute information.

If an operation to rotate the segment connecting the indication coordinates A2 and B2 is indicated as illustrated in FIG. 19B, the controller 3 changes the angle of the optical axis. In concrete terms, the storage unit 32 of the controller 3 stores the relational table that shows the relationship between the direction angle and the optical axis information. As the optical axis information, the storage unit 32 may store a table in which the rotational angles of the x coordinate, y coordinate and z coordinate are independent information, or may store a table in which the rotation angles of the x coordinate, y coordinate and z coordinate are dependent information.

The second operation screen is displayed according to the attribute information of the lighting apparatus 2. On the first operation screen illustrated in FIG. 10, for example, if an illustrated lighting apparatus 2*e* is selected, the "Color Temperature" button and the "RBG" button are displayed to set the color temperature and RGB, which are lighting information that can be set for this lighting apparatus. Whether the second graphic illustrated in FIG. 17 is displayed or the second graphic illustrated in FIG. 18A and FIG. 18B is displayed when the "Color Temperature" button is selected, is set for each lighting apparatus 2. If a lighting apparatus 2 can change the irradiation range of the illumination light, and if this lighting apparatus 2 is selected on the first operation screen, a "Beam Angle" button (not illustrated) is further displayed on the side of the first operation screen, and if this "Beam Angle" button is selected, the second operation screen having the second graphic illustrated in FIG. 18C is superposed on the first operation screen to display a dialog. Further, if a lighting apparatus 2 can change the irradiation range (beam angle) of the illumination light and the optical axis, a "Beam Angle/Optical Axis" button (not illustrated) is displayed as well on the side of the first operation screen. If this "Beam Angle/Optical Axis" button is selected, the second operation screen having the second graphic illustrated in FIG. 19A and FIG. 19B is superposed on the first operation screen to display a dialog.

The second operation screen to be displayed as a dialog has a title bar (see FIG. 11), and can be moved to any position on the display unit 31 by dragging and dropping the title bar. The display unit 31 can display a plurality of second operation screens all at once, in parallel or superposed on each other.

The lighting attribute information of conventional lighting apparatuses is mostly the dimming ratio of lighting fixtures. Recently, however, lighting apparatuses where a plurality of lighting emitting diodes having different luminescent colors is used as a light source, and the color temperature of the illumination light is variable, or the lighting apparatuses, of which irradiation range and the irradiation angle of the illumination light can be freely adjusted, are available, and the lighting attribute information to indicate the attribute of the lighting apparatus is diversified in addition to the luminosity of the illumination light. According to the lighting system 1, a general user can intuitively select a control target lighting apparatus in a target area where the lighting apparatuses 2 are installed, and can easily imagine the lighting attribute information such as the lighting state, and set this lighting attribute information with good operability.

Figure 20:
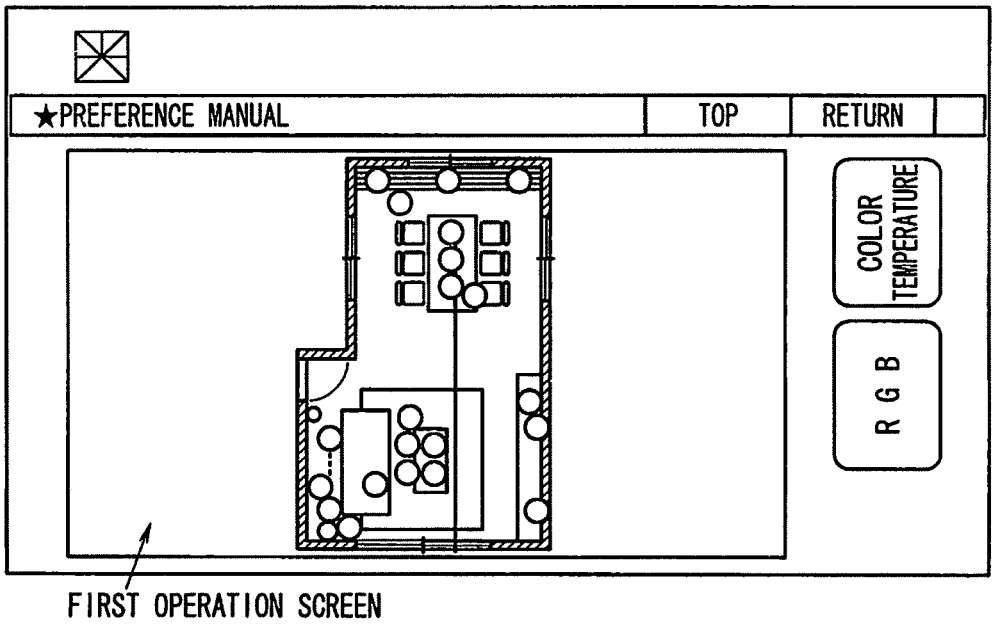
FIG. 20 is a diagram depicting a first operation screen (two-dimensional) displayed on the controller of the lighting system according to the embodiment of the present invention.

FIG. 4 shows the first operation screen, where a graphic, disposed on the three-dimensional space of a room in which lighting apparatuses 2 are installed, is displayed as the first graphic. FIG. 20, on the other hand, shows the first operation screen, where a graphic disposed on the two-dimensional space of a room in which the lighting apparatuses 2 are installed, is displayed as the first graphic, that is the first operation screen on which the floor plans of the room is displayed. The white circles in FIG. 20 are the positions where the lighting apparatuses 2 are disposed.

The display unit 31 here displays a first graphic, which is an area information in a positional relationship corresponding to the moving direction of the operation indication, on the first operation screen, when the operation indication linearly moves on the first operation screen. The first graphic that indicates the area information is the floor plan mentioned above, and the user can scroll the floor plan by performing the above mentioned operation.

Figure 21:
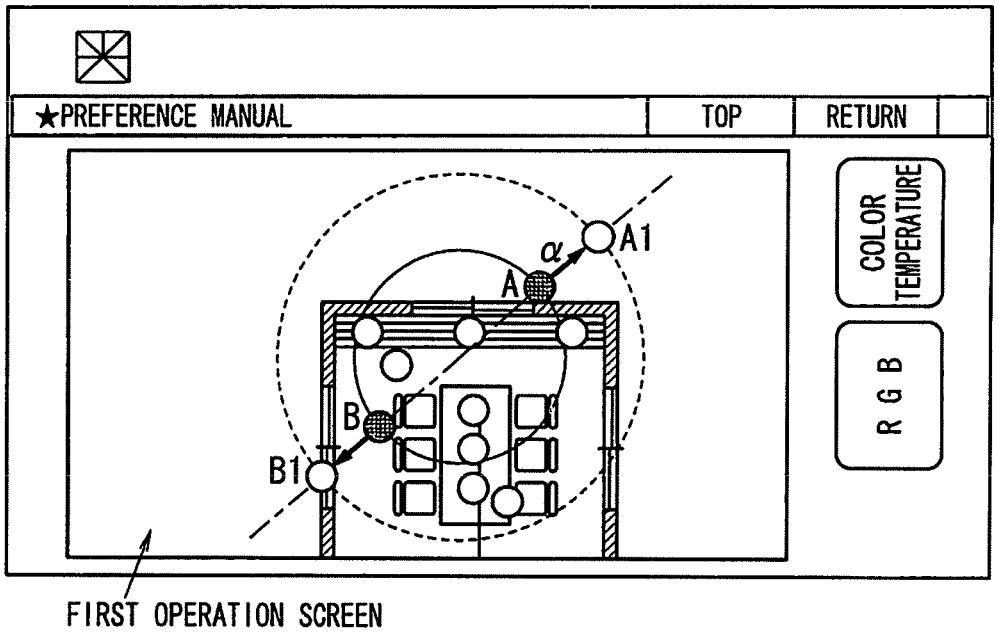
FIG. 21 is a diagram depicting an operation to zoom in on the first operation screen (two-dimensional) displayed on the controller of the lighting system according to the embodiment of the present invention.

When the two points of the indication coordinates are inputted as the operation indication on the first operation screen, and the distance between these indication coordinates is changed, the display unit 31 zooms in or zooms out of the first graphic included in the first operation screen with the center of the two indication coordinates as a reference according to the distance between the indication coordinates. In other words, by performing an operation to increase or to decrease the distance between the two points which the user touched with their fingers, the floor plan can be zoomed in (or zoomed out) as illustrated in FIG. 21. This operation is particularly effective when the size of the display unit 31 is relatively small and the graphic representing the lighting apparatus 2 is small, or when there are many graphics representing the lighting apparatuses 2 on the floor plan and it is difficult to touch these graphics with fingers. The zoom in/zoom out of the first operation screen using this operation is the same for a graphic illustrating the three-dimensional space in FIG. 4.

Figure 22:
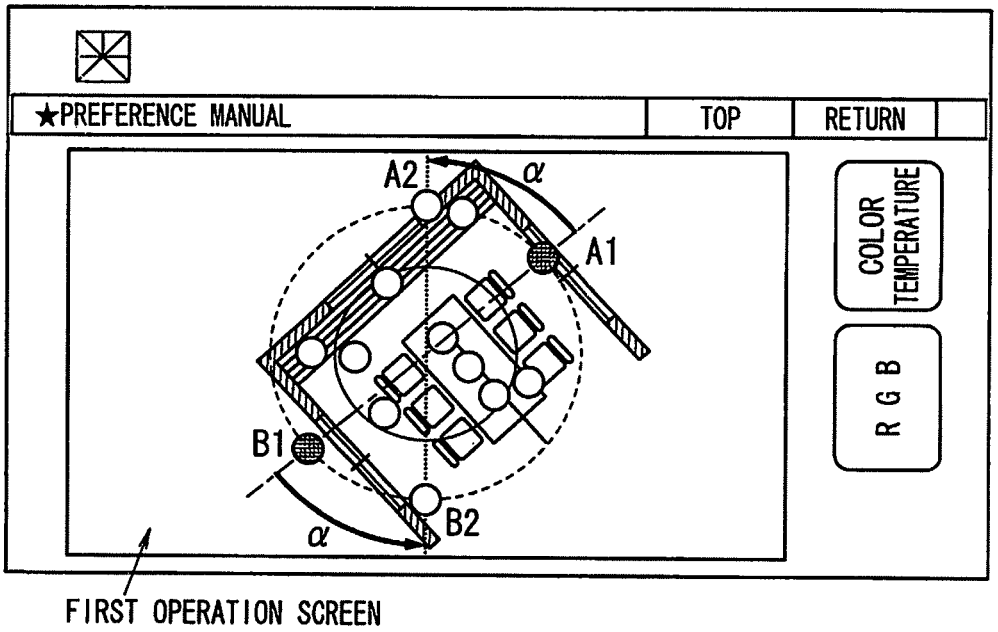
FIG. 22 is a diagram depicting an operation to rotate the first operation screen (two-dimensional) displayed on the controller of the lighting system according to the embodiment of the present invention.

Further, when two points of the indication coordinates are inputted as the operation indication on the first operation screen, and a segment connecting the indication coordinates is rotationally moved, the display unit 31 rotationally displays the first graphic included in the first operation screen with the center of the two indication coordinates as a reference according to the rotation angle thereof. In other words, by rotating the segment between the two points which the user touched with their fingers, the floor plan can be rotated as illustrated in FIG. 22. As illustrated in FIG. 1, the controller 3 is operated by the user who is in the space where the lighting apparatus 2 is installed, hence the direction the user is facing and the orientation of the floor plan displayed by the display unit 31 may be different. If this operation is used, the direction the user is facing and the orientation of the floor plan displayed by the display unit 31 can be matched.

The present invention is not limited to the above embodiments, but numerous modifications are possible. For example, a graphic to represent a lighting apparatus 2 may be stored in the storage unit 23*a* of the lighting apparatus 2 in advance as the identification information of the lighting apparatus 2, and this identification information may be updated by the controller 3. Further, the controller 3 may include a self-position detection unit using a GPS or the like, and may automatically compute the position of the room where the user having the controller 3 is, so that the first operation screen can be expanded without the user selecting the room.

As explained above, a lighting system 1 according to the present embodiment comprises lighting apparatuses 2, and a controller 3 for setting lighting control content of the lighting apparatuses 2. The controller 3 includes a display unit 31 that displays attribute information of the lighting apparatuses 2, an operation unit that is integrated with the display unit 31 and detects an operation indication, a storage unit 32 that stores the attribute information, and a transmitting/receiving unit 33 that transmits/receives a control signal including attribute information of the lighting apparatuses 2 to/from the lighting apparatuses 2. The storage unit 32 stores, as the attribute information, area information including a target area where the lighting apparatuses 2 are installed, identification information of the lighting apparatuses 2 in the target area, and lighting information on lighting conditions of the lighting apparatuses 2. The display unit 31 two-dimensionally or three-dimensionally displays a first operation screen that includes a first graphic generated from the area information and the identification information, and a second operation screen that includes a second graphic generated from the lighting information, respectively, and if a control target lighting apparatus 2 is selected from among the lighting apparatuses 2 on the first operation screen by an operation indication on the operation unit, the display unit 31 displays, as a dialog, the second operation screen having the second graphic corresponding to the selected lighting apparatus 2 so as to be superposed on the first operation screen, and if lighting information on the selected lighting apparatus 2 is selected on the second operation screen, the display unit 31 highlights a first graphic that indicates identification information of the selected lighting apparatus 2 and area information corresponding to the peripheral area of the selected lighting apparatus 2 on the first operation screen, so that the selected lighting information is reflected.

The identification information of the lighting apparatuses 2 includes position information of the lighting apparatuses 2 in the target area. When a lighting apparatus 2 is selected from among the lighting apparatuses 2 on the first operation screen by the operation indication, and coordinate information of the selected lighting apparatus 2 is moved, the storage unit 32 updates the position information of the selected lighting apparatus 2 based on the moved coordinate information. The display unit 31 displays a first graphic that indicates the updated position information of the selected lighting apparatus 2.

The storage unit 32 stores identification information of other lighting apparatuses 2 which are not installed in the target area. The display unit 31 displays a first graphic that indicates the identification information of the other lighting apparatuses 2 stored in the storage unit 32, in an area outside a first graphic that indicates the area information. When a lighting apparatus 2 is selected from among the other lighting apparatuses 2 on the first operation screen by the operation indication and coordinate information of the lighting apparatus 2 selected from among the other lighting apparatuses 2 moves inside the area information, the display unit 31 displays the identification information of the lighting apparatus 2 selected from among the other lighting apparatuses 2 in an area inside the first graphic that indicates the area information.

The storage unit 32 stores a plurality of pieces of lighting information relevant to each of the lighting apparatuses 2. The display unit 31 displays, on the second operation screen, a second graphic which displays the plurality of pieces of lighting information in one batch.

The storage unit 32 stores a plurality of pieces of lighting information relevant to each of the lighting apparatuses 2. The display unit 31 displays, on the second operation screen, a second graphic which associates together and displays the plurality of pieces of lighting information.

The storage unit 32 stores a plurality of pieces of lighting information relevant to each of the lighting apparatuses 2. The plurality of pieces of lighting information include dimming ratio information and color temperature information. The display unit 31 displays, on the second operation screen, a second graphic which indicates a predetermined dimming/toning curve defining the dimming ratio and the color temperature of the selected lighting apparatus 2 in association with each other. When one of the dimming ratio information and the color temperature information of the selected lighting apparatus 2 is selected on the second operation screen by an operation indication, the controller 3 automatically selects the other of the color temperature information and the dimming ratio information according to the dimming/toning curve.

The second graphic is circular, and when the operation indication is rotationally moved around the center point of the circle of the second graphic on the second operation screen, the controller 3 selects the lighting information according to a rotation angle thereof.

The second graphic is rectangular, and when the operation indication is linearly moved along a longitudinal direction of the second graphic on the second operation screen, the controller 3 selects the lighting information according to a moving distance thereof.

When two points of indication coordinates are inputted on the second operation screen as the operation indication, and a distance between the indication coordinates is changed, the controller 3 selects the lighting information according to the distance between the indication coordinates.

When two points of indication coordinates are inputted on the second operation screen as the operation indication, and a segment connecting the indication coordinates is rotationally moved, the controller 3 selects the lighting information according to a rotation angle thereof.

When the operation indication is linearly moved on the first operation screen, the display unit 31 displays, on the first operation screen, a first graphic which indicates area information of which positional relationship corresponds to a moving direction of the operation indication.

When two points of indication coordinates are inputted on the first operation screen as the operation indication, and a distance between the indication coordinates is changed, the display unit 31 zooms in or zooms out of a first graphic included in the first operation screen with the center of the two indication coordinates as a reference according to a distance between the indication coordinates.

When two points of indication coordinates are inputted on the first operation screen as the operation indication, and a segment connecting the indication coordinates is rotationally moved, the display unit 31 rotationally displays a first graphic included in the first operation screen with the center of the two indication coordinates as a reference according to a rotation angle thereof.

The lighting system 1 further comprises a regulator 4 that controls the lighting of the lighting apparatus 2 based on a control signal outputted from the controller 3.

The invention claimed is:

1. A lighting system comprising lighting apparatuses, and a controller for setting lighting control content of the lighting apparatuses, wherein the controller includes a display unit that displays attribute information of the lighting apparatuses, an operation unit that is integrated with the display unit and detects an operation indication, a storage unit that stores the attribute information, and a transmitting/receiving unit that transmits/receives a control signal including attribute information of the lighting apparatuses to/from the lighting apparatuses, the storage unit stores, as the attribute information, area information including a target area where the lighting apparatuses are installed, identification information of the lighting apparatuses in the target area, and lighting information on lighting conditions of the lighting apparatuses, the display unit two-dimensionally or three-dimensionally displays a first operation screen that includes a first graphic generated from the area information and the identification information, and a second operation screen that includes a second graphic generated from the lighting information, respectively, and when a control target lighting apparatus is selected from among the lighting apparatuses on the first operation screen by an operation indication on the operation unit, the display unit displays, as a dialog, the second operation screen having the second graphic corresponding to the selected lighting apparatus so as to be superposed on the first operation screen, and when lighting information on the selected lighting apparatus is selected on the second operation screen, the display unit highlights a first graphic that indicates identification information of the selected lighting apparatus and area information corresponding to the peripheral area of the selected lighting apparatus on the first operation screen, so that the selected lighting information is reflected.

2. The lighting system according to claim 1, wherein the identification information of the lighting apparatuses includes position information of the lighting apparatuses in the target area, and when a lighting apparatus is selected from among the lighting apparatuses on the first operation screen by the operation indication, and coordinate information of the selected lighting apparatus is moved, the storage unit updates the position information of the selected lighting apparatus based on the moved coordinate information, and the display unit displays a first graphic that indicates the updated position information of the selected lighting apparatus.

3. The lighting system according to claim 1, wherein the storage unit stores identification information of other lighting apparatuses which are not installed in the target area, and the display unit displays a first graphic that indicates the identification information of the other lighting apparatuses stored in the storage unit, in an area outside a first graphic that indicates the area information, and when a lighting apparatus is selected from among the other lighting apparatuses on the first operation screen by the operation indication and coordinate information of the lighting apparatus selected from among the other lighting apparatuses moves inside the area information, the display unit displays the identification information of the lighting apparatus selected from among the other lighting apparatuses in an area inside the first graphic that indicates the area information.

4. The lighting system according to claim 1, wherein the storage unit stores a plurality of pieces of lighting information relevant to each of the lighting apparatuses, and the display unit displays, on the second operation screen, a second graphic which displays the plurality of pieces of lighting information in one batch.

5. The lighting system according to claim 1, wherein the storage unit stores a plurality of pieces of lighting information relevant to each of the lighting apparatuses, and the display unit displays, on the second operation screen, a second graphic which associates together and displays the plurality of pieces of lighting information.

6. The lighting system according to claim 1, wherein the storage unit stores a plurality of pieces of lighting information relevant to each of the lighting apparatuses, the plurality of pieces of lighting information include dimming ratio information and color temperature information, the display unit displays, on the second operation screen, a second graphic which indicates a predetermined dimming/toning curve defining the dimming ratio and the color temperature of the selected lighting apparatus in association with each other, and when one of the dimming ratio information and the color temperature information of the selected lighting apparatus is selected on the second operation screen by an operation indication, the controller automatically selects the other of the color temperature information and the dimming ratio information according to the dimming/toning curve.

7. The lighting system according to claim 1, wherein the second graphic is circular, and when the operation indication is rotationally moved around the center point of the circle of the second graphic on the second operation screen, the controller selects the lighting information according to a rotation angle thereof.

8. The lighting system according to claim 1, wherein the second graphic is rectangular, and when the operation indication is linearly moved along a longitudinal direction of the second graphic on the second operation screen, the controller selects the lighting information according to a moving distance thereof.

9. The lighting system according to claim 1, wherein when two points of indication coordinates are inputted on the second operation screen as the operation indication, and a distance between the indication coordinates is changed, the controller selects the lighting information according to the distance between the indication coordinates.

10. The lighting system according to claim 1, wherein when two points of indication coordinates are inputted on the second operation screen as the operation indication, and a segment connecting the indication coordinates is rotationally moved, the controller selects the lighting information according to a rotation angle thereof.

11. The lighting system according to claim 1, wherein when the operation indication is linearly moved on the first operation screen, the display unit displays, on the first operation screen, a first graphic which indicates area information of which positional relationship corresponds to a moving direction of the operation indication.

12. The lighting system according to claim 1, wherein when two points of indication coordinates are inputted on the first operation screen as the operation indication, and a distance between the indication coordinates is changed, the display unit zooms in or zooms out of a first graphic included in the first operation screen with the center of the two indication coordinates as a reference according to a distance between the indication coordinates.

13. The lighting system according to claim 1, wherein when two points of indication coordinates are inputted on the first operation screen as the operation indication, and a segment connecting the indication coordinates is rotationally moved, the display unit rotationally displays a first graphic included in the first operation screen with the center of the two indication coordinates as a reference according to a rotation angle thereof.

14. The lighting system according to claim 1, further comprising a regulator that controls the lighting of the lighting apparatus based on a control signal outputted from the controller.

15. The lighting system according to claim 2, wherein the storage unit stores a plurality of pieces of lighting information relevant to each of the lighting apparatuses, and the display unit displays, on the second operation screen, a second graphic which displays the plurality of pieces of lighting information in one batch.

16. The lighting system according to claim 2, wherein the storage unit stores a plurality of pieces of lighting information relevant to each of the lighting apparatuses, and the display unit displays, on the second operation screen, a second graphic which associates together and displays the plurality of pieces of lighting information.

17. The lighting system according to claim 2, wherein the storage unit stores a plurality of pieces of lighting information relevant to each of the lighting apparatuses, the plurality of pieces of lighting information include dimming ratio information and color temperature information, the display unit displays, on the second operation screen, a second graphic which indicates a predetermined dimming/toning curve defining the dimming ratio and the color temperature of the selected lighting apparatus in association with each other, and when one of the dimming ratio information and the color temperature information of the selected lighting apparatus is selected on the second operation screen by an operation indication, the controller automatically selects the other of the color temperature information and the dimming ratio information according to the dimming/toning curve.

* * * * *